US010693222B2

(12) United States Patent
Tanaka et al.

(10) Patent No.: US 10,693,222 B2
(45) Date of Patent: Jun. 23, 2020

(54) METHOD OF MANUFACTURING ANTENNA DEVICE AND ANTENNA DEVICE

(71) Applicant: SUMIDA CORPORATION, Chuo-Ku, Tokyo (JP)

(72) Inventors: Kei Tanaka, Natori (JP); Shuichi Kikuchi, Natori (JP); Takanobu Rokuka, Natori (JP)

(73) Assignee: SUMIDA CORPORATION (JP)

( * ) Notice: Subject to any disclaimer, the term of this patent is extended or adjusted under 35 U.S.C. 154(b) by 49 days.

(21) Appl. No.: 16/048,795

(22) Filed: Jul. 30, 2018

(65) Prior Publication Data

US 2019/0074579 A1 Mar. 7, 2019

(30) Foreign Application Priority Data

Sep. 4, 2017 (JP) ..... 2017-169684

(51) Int. Cl.

| | |
|---|---|
| ***H01Q 7/00*** | (2006.01) |
| ***H01Q 7/08*** | (2006.01) |
| ***H01Q 1/40*** | (2006.01) |
| ***H01Q 1/32*** | (2006.01) |
| ***H01Q 1/36*** | (2006.01) |

(52) U.S. Cl.

CPC ..... *H01Q 1/40* (2013.01); *H01Q 1/3241* (2013.01); *H01Q 1/36* (2013.01); *H01Q 7/00* (2013.01); *H01Q 7/08* (2013.01)

(58) Field of Classification Search

CPC ..... H01Q 1/3241; H01Q 1/32; H01Q 1/22; H01Q 1/36; H01Q 1/40; H01Q 7/00; H01Q 7/08

See application file for complete search history.

(56) References Cited

U.S. PATENT DOCUMENTS 6,400,330 B1 6/2002 Maruyama et al.
9,407,009 B2 * 8/2016 Mahara ..... H01Q 7/00
(Continued)

FOREIGN PATENT DOCUMENTS

CN 103682616 A 3/2014
JP 2001-358522 A 12/2001
(Continued)

OTHER PUBLICATIONS

Extended European Search Report for Patent Application No. EP 18189905.5, dated Jan. 30, 2019 (9 pages).

*Primary Examiner* — Tho G Phan
(74) *Attorney, Agent, or Firm* — Harness, Dickey & Pierce, P.L.C.

(57) ABSTRACT

A method of manufacturing an antenna including: forming an integrated assembly that is configured with a core, a bobbin disposed around the core and having a flange, and a coil disposed around the bobbin; supplying a liquid filler material into an inner space of a case, the case having an opening; inserting the integrated assembly into the inner space of the case via the opening before or after the supplying of the liquid filler material; closing the opening with the flange; concentrating the liquid filler material toward the flange in the inner space; curing the liquid filler material after the concentrating so as to form a cured filler material; and fixedly supporting the integrated assembly within the case via the cured filler material at a position directly adjacent to the opening of the case.

23 Claims, 13 Drawing Sheets

(56) References Cited

U.S. PATENT DOCUMENTS

| | | | | |
|---|---|---|---|---|
| 9,647,340 | B2 * | 5/2017 | Yagi | H01Q 7/06 |
| 9,768,510 | B2 * | 9/2017 | Tanaka | H01Q 1/3241 |
| 10,141,649 | B2 * | 11/2018 | Miura | H01Q 1/36 |
| 2002/0033777 | A1 | 3/2002 | Maruyama et al. | |
| 2014/0145904 | A1 * | 5/2014 | Yoshikawa | H01Q 7/06 343/867 |
| 2015/0295315 | A1 | 10/2015 | Tanaka et al. | |

FOREIGN PATENT DOCUMENTS

| | | | |
|---|---|---|---|
| JP | 2008-211643 | A | 9/2008 |
| JP | 2010-016549 | A | 1/2010 |

* cited by examiner

METHOD OF MANUFACTURING ANTENNA DEVICE AND ANTENNA DEVICE

CROSS-REFERENCE TO RELATED APPLICATION

This application claims priority to Japanese Patent Application No. 2017-169684 filed Sep. 4, 2017, which is hereby expressly incorporated by reference herein in its entirety.

BACKGROUND

Technical Field

The present invention relates to a method of manufacturing an antenna device and an antenna device.

Related Art

In the recent years, smart key systems have become quite popular in vehicles, such as cars, and homes. A smart key system wirelessly transmits and receives information that relates to, for example, an ID code as an electromagnetic wave. When such an ID code is collated, an owner can perform operations, for instance, to lock and unlock a door of such a vehicle or house, or to start and stop the engine without using a mechanical key. In the smart key system mentioned above, an antenna device, which has a coil antenna to transmit and receive the information, is used.

An antenna device explained above is configured with a rod (bar)-like shaped core, a bobbin for housing the rod (bar)-like shaped core and a coil being formed by winding a wire around the bobbin as essential parts as described in Japanese Patent Publication No. 2001-358522.

Meanwhile, the rod (bar)-like shaped core is composed with a brittle material such as a ferrite. Therefore, even though the rod (bar)-like shaped core is housed in the bobbin, when the impact is applied by such as a falling, the rod (bar)-like shaped core is easily damaged. In addition, the antenna device having the damaged rod (bar)-like shaped core cannot communicate at a target frequency because of a decrease in inductance and variations in a resonance frequency of the antenna device.

SUMMARY

The present invention is accomplished in order to solve these problems explained above. An object of the present invention is to provide a method of manufacturing an antenna device and an antenna device that can suppress a damage of a rod (bar)-like shaped core even when the impact is applied.

In order to achieve the above object, a method of manufacturing an antenna device according to one aspect of the present invention includes: forming an integrated assembly that is configured with: a core; a bobbin disposed around the core, the bobbin having a flange; and a coil disposed around the bobbin; supplying a liquid filler material into an inner space of a case, the case having an opening; inserting the integrated assembly into the inner space of the case via the opening before or after the supplying of the liquid filler material; closing the opening with the flange; concentrating the liquid filler material toward the flange in the inner space; curing the liquid filler material after the concentrating so as to form a cured filler material; and fixedly supporting the integrated assembly within the case via the cured filler material at a position directly adjacent to the opening of the case.

A method of manufacturing an antenna device according to another aspect of the present invention, further including supplying the liquid filler material into the case in an amount that is equal to or less than a half of an inner volume of the inner space of the case.

In a method of manufacturing an antenna device according to another aspect of the present invention, the case has a closed end that is located opposite to the opening. In the supplying, locating the closed end lower than the opening with respect to horizontal and supplying the liquid filler material into the inner space of the case before inserting the integrated assembly into the inner space of the case. In the inserting, locating the opening higher than the closed end with respect to the horizontal, and inserting the integrated assembly into the inner space of the case containing the liquid filler material via the opening. After the opening is closed by the flange, rotating the case until the opening is located lower than the closed end with respect to the horizontal.

In a method of manufacturing an antenna device according to another aspect of the present invention, the liquid filler material is liquid urethane rubber. In the rotating, the case is rotated until the opening is located lower than the closed end and the liquid urethane rubber is caused to flow along a periphery of the integrated assembly. In the curing, covering at least part of the periphery of the integrated assembly with a film of cured urethane rubber.

In a method of manufacturing an antenna device according to another aspect of the present invention, in the rotating, the case is rotated until substantially vertical. The curing is performed while the case is substantially vertical.

In a method of manufacturing an antenna device according to another aspect of the present invention, in the rotating, the case is rotated until the case is inclined relative to vertical. The curing is performed while the case is inclined.

In a method of manufacturing an antenna device according to another aspect of the present invention, the case has an inlet through which the liquid filler material is supplied. The supplying further includes: inserting a tip of a dispenser into the inlet, and thereafter supplying the liquid filler material into the inner space of the case via the dispenser.

An antenna device according to one aspect of the present invention includes: an integrated assembly that is configured with: a core; a bobbin disposed around the core, the bobbin having a flange; and a coil disposed around the bobbin. A case houses the integrated assembly. The case has an opening at a first end and a closed end at a second end opposite to the first end. The flange closes the opening. A cured filler material is disposed directly adjacent to the flange in an inner space of the case. Further, an amount of the cured filler material is equal to or less than a half of an inner volume of the inner space of the case.

In an antenna device according to another aspect of the present invention, the cured filler material is urethane rubber. Further, a film of the urethane rubber covers at least part of a periphery of the integrated object.

In an antenna device according to another aspect of the present invention, the flange has a fin and a recess. Further, the fin and the recess are disposed directly adjacent to each other. The cured filler material is in the recess.

In an antenna device according to another aspect of the present invention, the bobbin has two pairs of opposite outer surfaces and the case has two pairs of opposite inner surfaces. Further, each of two opposite outer surfaces of one of the two pairs of opposite outer surfaces of the bobbin has a fitting projection. Each of two opposite inner surfaces of one of the two pairs of opposite inner surfaces of the case has a fitting recess. The fitting projections are fit into the fitting recesses. Further, the other of the two pairs of opposite outer surfaces of the bobbin are spaced apart from the other of the two pairs of opposite inner surfaces of the case.

In an antenna device according to another aspect of the present invention, the fitting recess is configured with a pair of projections. Further, a tip of the fitting projection is nested within a cavity defined by the pair of projections and a bottom of the fitting recess.

In an antenna device according to another aspect of the present invention, a cross section of an inner surface of the bobbin is rectangular having four sides and two opposite sides are longer than two other opposite sides. Further, a holding projection is disposed on the inner surface of the bobbin at one of the two opposite sides and the two other opposite sides, and the holding projection contacts an outer surface of the core.

In an antenna device according to another aspect of the present invention, a width of a tip of the holding projection is smaller than a width of a base of the holding projection.

In an antenna device according to another aspect of the present invention, the integrated assembly has a connection terminal to which a wire of the coil is connected. The core is elongated in a longitudinal direction. The holding projection is located between the connection terminal and a longitudinal center of the core.

In an antenna device according to another aspect of the present invention, a flange holding projection is disposed on an inner surface of the flange facing the inner space. An end of the core contacts the flange holding projection so that the end of the core is spaced apart from the inner surface of the flange.

In an antenna device according to another aspect of the present invention, the integrated assembly has a connection terminal to which a wire of the coil is connected. A terminal mounting part is located at a position directly adjacent to one end of the core in a longitudinal direction of the core. The terminal mounting part is located directly adjacent to the connection terminal. The bobbin has a bobbin opening that is located directly adjacent to the terminal mounting part.

In an antenna device according to another aspect of the present invention, the core is supported by the inner surface of the bobbin that is located opposite to the bobbin opening. The inner surface that is opposite to the bobbin opening is configured with a flat surface, an edge, and a step. The edge is continuously connected between an end of the flat surface and an end of the step. The core is configured to move by using the edge as a fulcrum when an external force is applied to the antenna device.

In an antenna device according to another aspect of the present invention, the case includes: a tubular storage that houses the integrated assembly; a pair of risers that outwardly extend from the tubular storage so that the tubular storage is spaced apart from an external part; and a case mount that is fixed to the external part. A space is provided between the pair of risers.

In an antenna device according to another aspect of the present invention, one of the pair of risers is provided directly adjacent to one end of the tubular storage in a longitudinal direction of the tubular storage. The other of the pair of risers is provided directly adjacent to the other end of the tubular storage in the longitudinal direction of the tubular storage. Further, each of the pair of risers has two projections that are provided at both ends of the tubular storage in a width direction of the tubular storage, respectively, and the two projections are connected by a beam plate.

In an antenna device according to another aspect of the present invention, the tubular storage is a quadrangular prism. Further, the two projections continuously extend from two parallel side surfaces of the tubular storage so that two projections are parallel to each other. The beam plate is perpendicular to the two projections.

In an antenna device according to another aspect of the present invention, the tubular storage is a quadrangular prism. Further, the case mount is configured with a pair of side extension plates spaced apart from each other. The pair of side extension plates extend from a side surface of the tubular storage. A cutout is provided between the pair of side extension plates.

In an antenna device according to another aspect of the present invention, the tubular storage is a quadrangular prism. The case mounting part is in a plate shape. A rib plate connects the tubular storage and the case mount. Further, the rib plate is perpendicular to a mounting surface of the case mount and perpendicular to side surfaces of the tubular storage. The rib plate is provided at each of two edges of the mounting surface of the case mount.

According to the present invention, it possible to provide a method of manufacturing an antenna device and an antenna device that can suppress a damage for a rod (bar)-like shaped core even when the impact is applied.

BRIEF DESCRIPTION OF THE DRAWINGS

FIG. 7A is the plan view that shows the core holding projection that has a triangular cross sectional shape. FIG. 7B is the plan view that shows the core holding projection that has a semielliptical cross sectional shape. FIG. 7C is the plan view that shows the core holding projection that has a trapezoid cross sectional shape.

FIG. 17A is the schematic view that shows a state in which the liquid filler is injected inside a case. FIG. 17B is the schematic view that shows a halfway stage of inserting the integrated assembly located inside of the case. Further, FIG. 17C is the schematic view that shows a state in which the insertion of the integrated assembly inside of the case is completed.

FIG. 18A is the schematic view that shows a state in which the liquid filler is downwardly accumulated by being overturned. FIG. 18B is the schematic view that shows a state in which the liquid filler is cured and the cured resin part is formed.

FIG. 19A is the schematic view that shows a state in which the liquid filler is injected by inclining a case and an integrated assembly in a state in which an opening of the case faces downward in a vertical direction. FIG. 19B is the schematic view that shows a state in which the liquid filler is cured.

DESCRIPTION OF EXEMPLARY EMBODIMENTS

Figure 1:
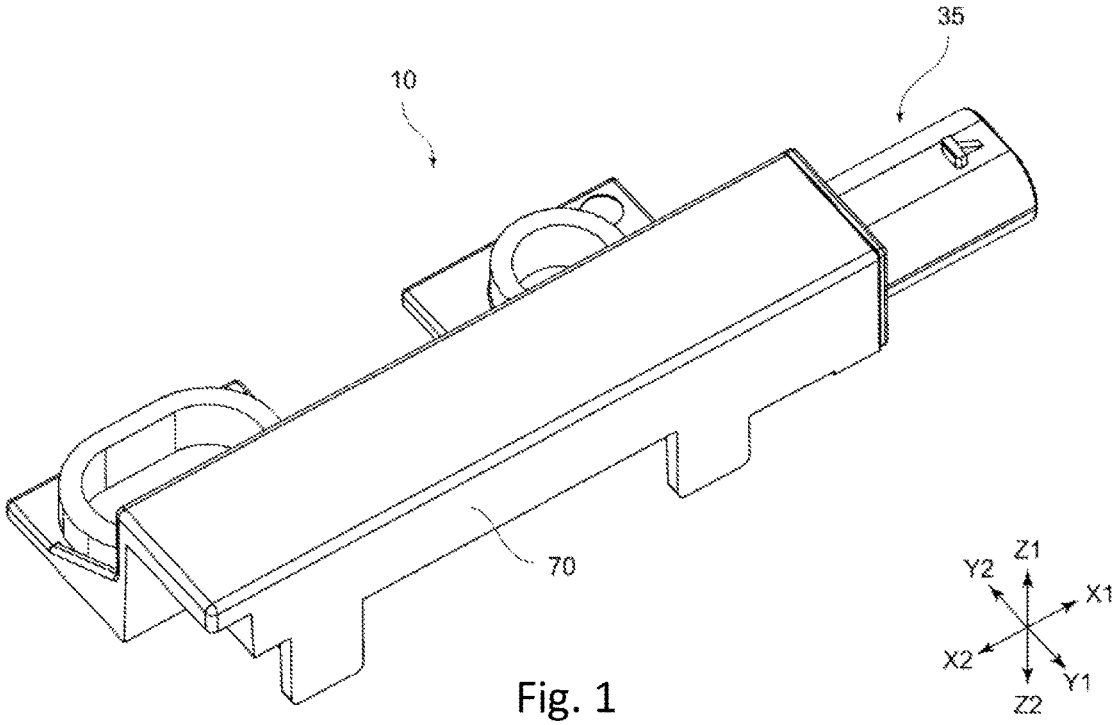
FIG. 1 is a perspective view that shows an example of an overall configuration of an antenna device according to a first embodiment of the present invention.

An antenna device 10 according to each of embodiments of the present invention will be explained below with reference to the drawings. Further, an X-direction, a Y-direction, and a Z-direction shown in the drawings are defined to be directions being perpendicular to one another in the following embodiments. Specifically, the X-direction is a parallel direction (a length direction of the antenna device 10) parallel to a length direction (an axis direction C) of a rod (bar)-like shaped core 20. Further, the Y-direction is a parallel direction (a width direction of the antenna device 10) parallel to a long side direction on a rectangular cross section of the rod (bar)-like shaped core 20. Lastly, the Z-direction is a parallel direction (a thickness direction of the antenna device 10) parallel to a short side direction on the rectangular cross section of the core 20. In addition, an X1 side (direction) is opposite to an X2 side (direction) in the X-direction. Further, a Y1 side (direction) is opposite to a Y2 side (direction) in the Y-direction. Lastly, a Z1 side (direction) is opposite to a Z2 side (direction) in the Z-direction. Further, a circumferential direction R (See FIG. 2) is a direction with respect to the axis direction C of the core 20 that is parallel to the X-direction.

Figure 2:
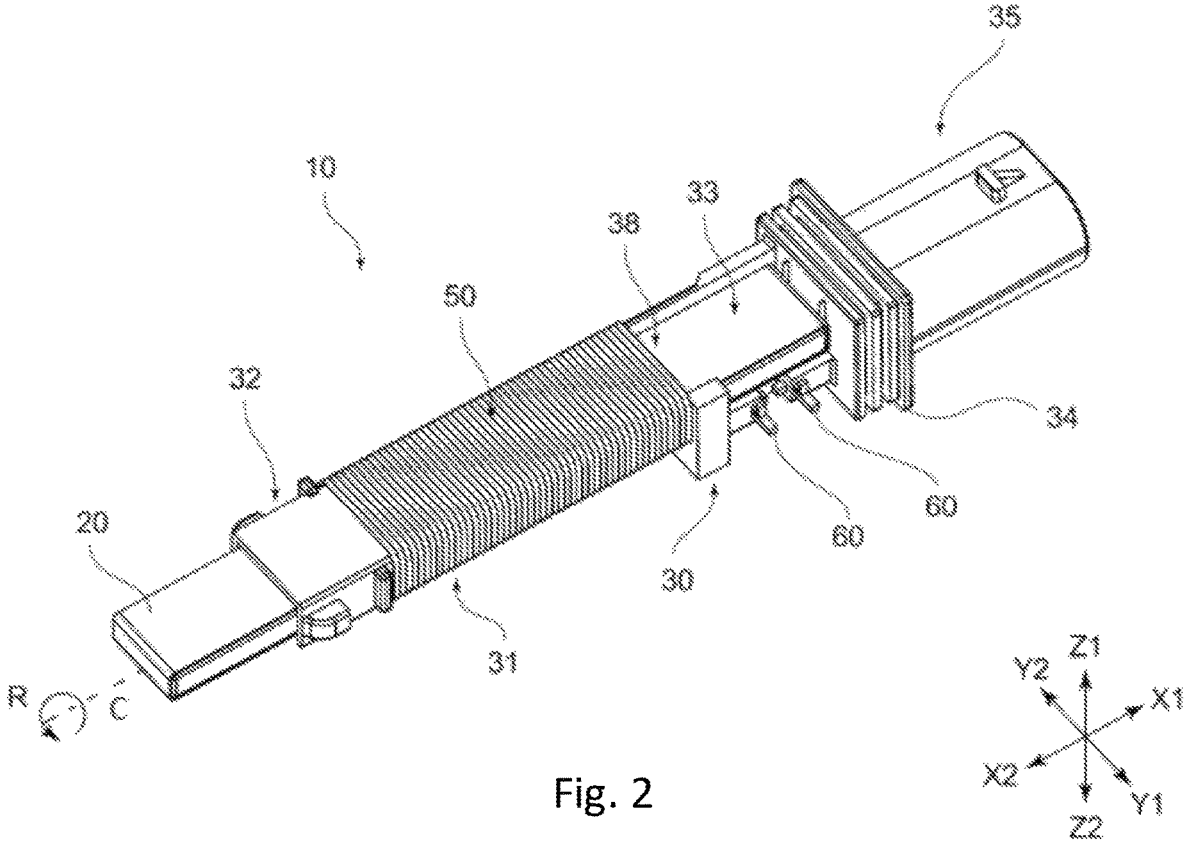
FIG. 2 is a perspective view that shows a state in which a case is removed from the antenna device shown in FIG. 1 according to the first embodiment of the present invention.
Figure 3:
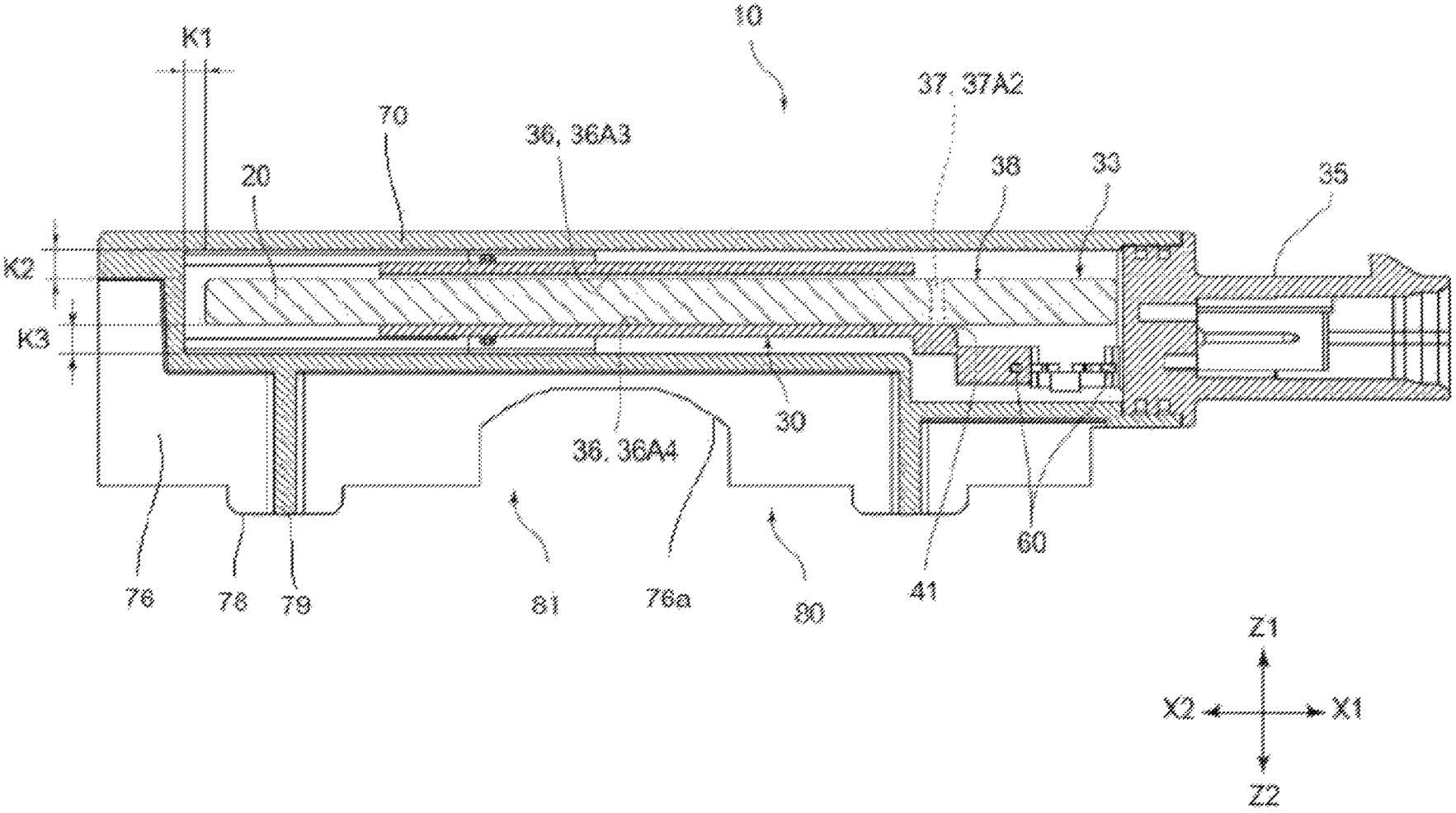
FIG. 3 is a side cross sectional view that shows a cross section structure of the antenna device shown in FIG. 1 according to the first embodiment of the present invention.
Figure 4:
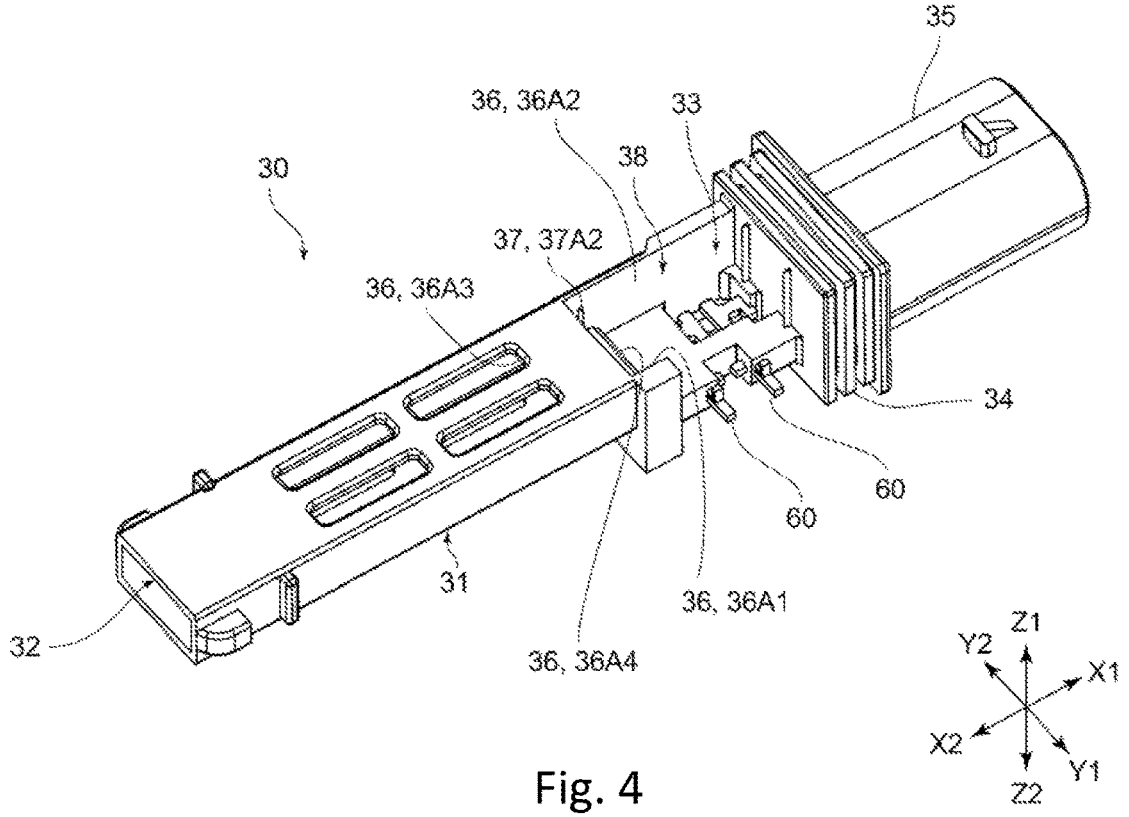
FIG. 4 is a perspective view that shows a state in which a case, a coil, and a core are removed from the antenna device shown in FIG. 1 according to the first embodiment of the present invention.

FIGS. 1-4 are schematic views that show an example of the antenna device 10 according to an embodiment of the present invention. FIG. 1 is a perspective view that shows an example of an overall configuration of the antenna device 10 according to the embodiment of the present invention. FIG. 2 is a perspective view that shows a state in which a case 70 is removed from the antenna device 10 shown in FIG. 1. FIG. 3 is a side cross sectional view that shows a cross section structure of the antenna device 10 shown in FIG. 1. FIG. 4 is a perspective view that shows a state in which the case 70, a coil 50, and the core 20 are removed from the antenna device 10 shown in FIG. 1.

The antenna device 10 according to the first embodiment of the present invention shown in FIG. 1 is configured with the core 20, a bobbin body 30, and the coil 50 as main components. Specifically, the core 20 is formed with a magnetic material and its cross-sectional view is in rectangular and rod (bar)-like shape (as a rectangular bar). The bobbin body 30 houses the core 20 and its cross-sectional view is in a rectangular shape. Further, the coil 50 is formed by being wound by a wire 52.

The bobbin body 30 has a bobbin part 31, a tip fitting part 32, a terminal mounting part 33, a flange part 34, and a connector connection part 35 as main components. The coil 50 is provided by being wound by the wire 52 on the bobbin part 31. Further, the tip fitting part 32 is continuously provided on the other side (the X2 side) of the bobbin part 31 in a longitudinal direction (the X-direction). When the bobbin body 30 is inserted into the case 70, the tip fitting part 32 can achieve a fitting structure inside the case 70.

The terminal mounting part 33 is continuously provided at one side (the X1 side) of the bobbin part 31 in the longitudinal direction (the X-direction). Connection terminals 60 are attached to the terminal mounting part 33. Further, ends of the wire 52 of the coil 50 entwine the connection terminals 60. The connection terminals 60 are electrically connected to, for example, an electronic component. When the bobbin body 30 is cut in a direction (the Y-direction) perpendicular to the longitudinal direction (the X-direction), a cross sectional area of the flange part 34 (an area of a ZY-plane) is the largest. The flange part 34 separates the terminal mounting part 33 from the connector connection part 35. One end of the case 70 is attached to the flange part 34 in a fitting state. Further, an external connector is connected to the connector connection part 35.

The connection terminals 60 are provided in the vicinity of one end (the X1 side) of the core 20. The connection terminals 60 are attached inside the terminal mounting part 33 that is provided at one end (the X1 side) of the bobbin body 30. Further, the bobbin body 30 houses the core 20 therein and has the coil 50 that is provided at an outer circumference of the bobbin body 30. That bobbin body 30 including the terminal mounting part 33 is housed in the case 70 as shown in FIG. 1. Further, the connector connection part 35 is provided on the end surface of one side (the X1 side) of the flange part 34 so that the bobbin body 30 extends in the longitudinal direction (the X-direction).

Figure 5:
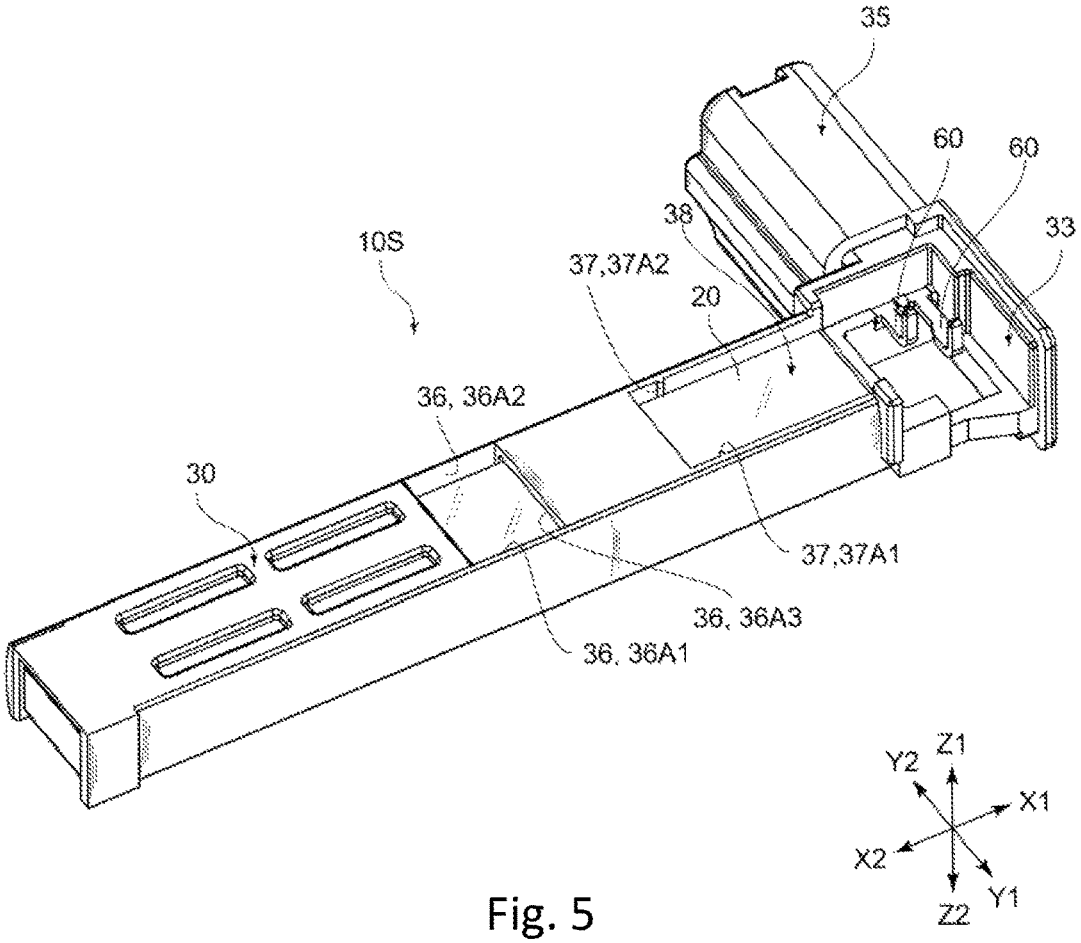
FIG. 5 is a perspective view that shows a state in which a case and a coil are removed from the antenna device shown in FIG. 1 according to a variation of the first embodiment of the present invention.

The antenna device 10 is not limited to the configuration shown in FIGS. 1-4. Another type of an antenna device, which is different from the antenna device 10 shown in FIGS. 1-4, is shown in FIG. 5. In regards with an antenna device 10S shown in FIG. 5, the connector connection part 35 is provided along the width direction (the Y-direction) that is perpendicular to the longitudinal direction (the X-direction). However, other structures/elements of the antenna device 10S are the same as the antenna device 10 shown in FIGS. 1-4.

Next, the relative arrangement of the core 20 and the bobbin body 30 will be explained below. First, a core holding projection 37 that is provided at the bobbin body 30 will be explained below. A pair of core holding projections 37 (projections) are formed on inner circumference surfaces 36 of the bobbin body 30 of the antenna device 10 separately. The cross-section of the inner circumference surfaces 36 is rectangular-shaped. In a circumferential direction R of the cross-section of the bobbin body 30, there are a pair of short sides that are parallel to each other, and a pair of long sides that are parallel to each other. A pair of surfaces in the circumference surfaces 36 including the short sides are referred to as "narrow-width inner circumference surfaces 36A1 and 36A2", and a pair of surfaces in the circumference surface 36 including the long sides are referred to as "wide-width inner circumference surfaces 36A3 and 36A4." The pair of core holding projections 37 are formed separately on at least one pair of the circumference surfaces 36 chosen from the narrow-width inner circumference surfaces 36A1 and 36A2 and the wide-width inner circumference surfaces 36A3 and 36A4. Further, the pair of core holding projections 37 extends in the circumferential direction R of the bobbin body 30 so that the pair of core holding projections 37 contacts an outer circumference surface of the core 20. For instance, in regards to the configurations shown in FIGS. 2-4, the pair of core holding projections 37 are provided to the narrow-width inner circumference surfaces 36A1 and 36A2 of the inner circumference surfaces 36 of the bobbin body 30. Further, the narrow-width inner circumference surfaces 36A1 and 36A2 correspond to first inner circumference surfaces. The wide-width inner circumference surfaces 36A3 and 36A4 correspond to second inner circumference surfaces.

In FIGS. 2-4, as necessary, the inner circumference surface 36 that is located on one side (the Y1 side) of the antenna device 10 in the width direction (the Y-direction) is defined to be the narrow-width inner circumference surface 36A1. The inner circumference surface 36 that is located on the other side (the Y2 side) of the antenna device 10 in the width direction (the Y-direction) is defined to be the narrow-width inner circumference surface 36A2. Further, the core holding projection 37 that is located on the narrow-width inner circumference surface 36A1 is defined to be the core holding projection 37A1. The core holding projection 37 that is located on the narrow-width inner circumference surface 36A2 is defined to be the core holding projection 37A2. Further, the inner circumference surface 36 that is located on an upper side (the Z1 side) is defined to be the wide-width inner circumference surfaces 36A3. The inner circumference surface 36 that is located on a lower side (the Z2 side) is defined to be the wide-width inner circumference surfaces 36A4.

Figure 6:
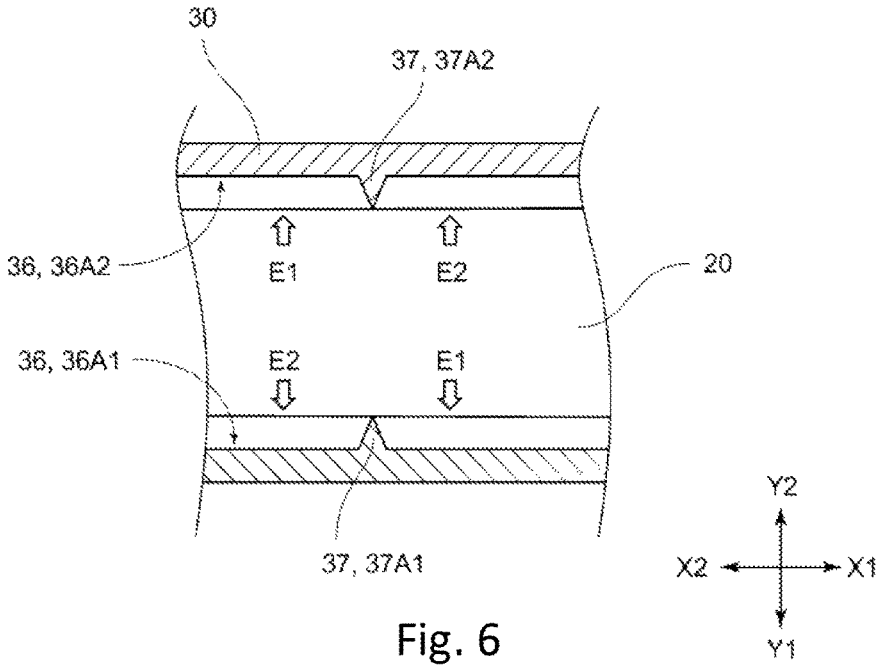
FIG. 6 is a plan view that shows a state in which core holding projections contact an outer circumference surface of a core according to an embodiment of the present invention.

As shown in FIG. 6, the core holding projections 37 explained above maintain the core 20 inside the bobbin body 30 by contacting the outer circumference surface(s) of the core 20 (in an example shown in FIG. 6, the outer circumference surfaces, which face the narrow-width inner circumference surfaces 36A1 and 36A2, of the core 20). Therefore, when the impact is applied to the antenna device 10, the core 20 slightly moves (swings) (moves on the XY surface) in an arrow E1 direction or in an arrow E2 direction shown in FIG. 6 inside the bobbin body 30 with the core holding projections 37A1 and 37A2 as fulcrums. As a result, the impact force being transmitted to the core 20 via the bobbin body 30 can be mitigated. Further, because the core 20 slightly moves on the XZ surface with the core holding projections 37A1 and 37A2 as the fulcrums, the impact force being transmitted to the core 20 via the bobbin body 30 can also be mitigated. As a result, even when the impact is applied to the antenna device 10, the possibility of a break of the core 20 can be significantly reduced.

As shown in FIG. 6, the core holding projection 37 is respectively provided on two inner circumference surfaces 36 that are parallel to each other. In contrast, when the core holding projection 37A1 is provided on only either one of the inner circumference surfaces 36 (in FIG. 6, for instance, the narrow-width inner circumference surface 36A1) and when the core holding projection 37A2 is not provided on the other of the inner circumference surfaces 36 (for instance, the narrow-width inner circumference surface 36A2), the following problems occur. When the entire surface of the other of the inner circumference surfaces 36 is closely contacted to the core 20, the core 20 cannot slightly move. On the other hand, when a gap is provided between the entire surface of the other of the inner circumference surfaces 36 and the core 20, the core 20 cannot be stably fixed and held inside the bobbin body 30.

Further, it is preferred that the core holding projection 37A1 being provided on the narrow-width inner circumference surface 36A1 and the core holding projection 37A2 being provided on the narrow-width inner circumference surface 36A2 are located at the predetermined positions or are located so as to be unevenly distributed within a predetermined range along the longitudinal direction of the bobbin body 30. For instance, when an entire length of a storage part housing the core 20 of the bobbin body 30 in the longitudinal direction is presumed to be a relative length 100, one end (the end of the X1 side) is presumed as the position 0 and the other end (the end of the X2 side) is presumed as the position 100.

Under the above presumptions, it is possible that the core holding projections 37A1 and 37A2 are provided only at the position 20 that is located on the side of the connection terminal 60 relative to the center of the storage part in the longitudinal direction. Further, it is possible that the core holding projections 37A1 and 37A2 are located only within a range of the position 40—the position 50 (within a range of the relative length 10). In contrast, when a plurality of core holding projections 37A1 and 37A2 are extensively unevenly distributed along the longitudinal direction of the bobbin body 30 (for instance, the core holding projection 37A1 is located at the position 20 and the core holding projection 37A2 is located at the position 80) and when the impact force is applied, the slight movement of the core 20 becomes difficult or the range for the slight movement becomes significantly limited. As a result, there is a possibility that it becomes difficult to significantly mitigate the impact force being transmitted to the core 20 via the bobbin body 30.

In consideration of the issues explained above, it is preferred that the core holding projections 37A1 and 37A2 are provided so as to be unevenly distributed within the range of the relative length 20 (the positions of the core holding projections 37A1 and 37A2 in the longitudinal direction are separated from each other within the range of the relative length 20). It is more preferred that the core holding projections 37A1 and 37A2 are provided so as to be unevenly distributed within the range of the relative length 10. Further, as shown in FIG. 6, it is the most preferred that the core holding projections 37A1 and 37A2 are provided at the same position in the longitudinal direction. In addition, in order to avoid the state in which the core 20 cannot move freely by the influence of tightening force of the coil 50, it is preferred that the core holding projections 37A1 and 37A2 are provided between one end side (the X1 side) of the winding part of the coil 50 and the terminal mounting part 33.

Further, the core holding projections 37 can be provided at an arbitrary position as its arrangement position at the storage part of the bobbin body 30 housing the core 20 in the longitudinal direction as long as the slight movement of the core 20 is possible.

Figure 8:
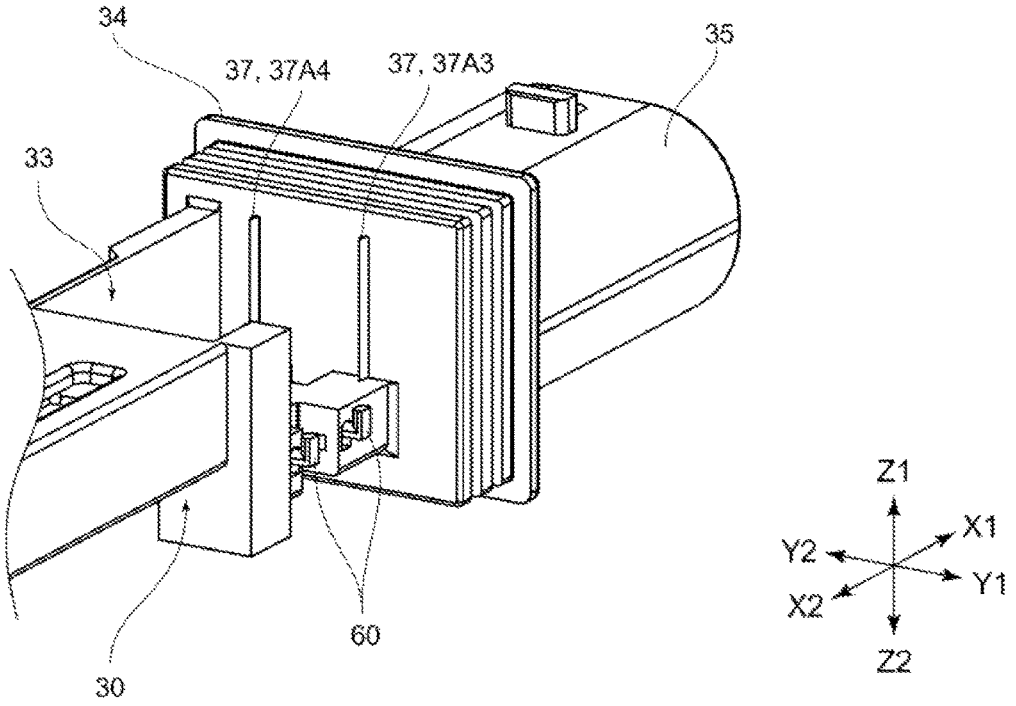
FIG. 8 is a perspective view that shows core holding projections that contact an end surface of one end side of the core in a longitudinal direction according to an embodiment of the present invention.

In addition, the core holding projections 37 can also be provided at any position other than the narrow-width inner circumference surfaces 36A1 and 36A2 of the bobbin body 30. FIG. 8 is a perspective view that shows the core holding projections 37 (core holding projections 37A3 and 37A4) that contacts an end surface of one end side (the X1 side) of the core 20 in the longitudinal direction (the X-direction). As shown in FIG. 8, the core holding projections 37A3 and 37A4 are provided on the end surface (the surface of the X2 side) that is the other side of the flange part 34. Further, the core holding projections 37A3 and 37A4 extend along the vertical direction (the Z-direction). Though the core holding projections 37A3 and 37A4 contact the end surface of one end side (the end surface of the X1 side) of the core 20, the core holding projections 37A3 and 37A4 can also be slightly apart from the end surface of the core 20.

As explained above, because the end surface of one end side (the surface of the X1 side) of the core 20 contacts the core holding projections 37A3 and 37A4, the end surface of the core 20 does not contact the end surface of the flange part 34 in its entirety. Therefore, it is realized that one end surface of one end side (the surface of the X1 side) of the core 20 partially contacts the end surface of the flange part 34. As a result, when the antenna device 10 is fallen down, the end surface of one end side (the surface of the X1 side) of the core 20 can slightly move along the Z-direction so that the falling impact can be mitigated. In other words, there is a gap between one end side (the X1 side) of the core 20 and the other end side (the X2 side) of the flange part 34 because the core holding projections 37A3 and 37A4 exists on the end surface of the flange part 34. When the impact is applied, one end side (the X1 side) of the core 20 can slightly rotate while compressing the core holding projections 37A3 and 37A4 because there is the gap. Therefore, the momentary impact force can be mitigated and absorbed.

In the configurations shown in FIGS. 6 and 8, when the impact is applied to the antenna device 10, the impact is transmitted from the bobbin body 30 to the core 20 via a first contact part and a second contact part. Specifically, the core holding projections 37A1 and 37A2 directly contact the core 20 at the first contact part. The core holding projections 37A3 and 37A4 directly contact the core 20 at the second contact part.

In the present technology, the impact force is mitigated by providing a material having flexibility such as a resin at a space between the bobbin body 30 and the case 70. However, according to the embodiment of the present invention, the falling impact force for the antenna device 10 is selectively guided to relatively strong surfaces, i.e., hard-to-break surfaces, of the core 20 by using the core holding projections 37 explained above, and as a result, the cracking of the core 20 is reduced.

In order to decrease the cracking in the middle of the coil 20, it is more preferred that the core holding projections 37A1 and 37A2 are provided in the vicinity of one end or in the vicinity of the other end of the storage part of the bobbin body 30 housing the core 20 in the longitudinal direction, not in the vicinity of the center of the storage part of the bobbin body 30 housing the core 20 in the longitudinal direction. Note that when such storage part is divided into three areas in the longitudinal direction, the vicinity of the center of the storage part of the bobbin body 30 housing the core 20 in the longitudinal direction corresponds to the center area, and the other two areas at both sides correspond to the vicinity of one end and the vicinity of the other end of the storage part of the bobbin body 30 housing the core 20 in the longitudinal direction.

The core holding projections 37A1 and 37A2 can be provided on the narrow-width inner circumference surfaces 36A1 and 36A2 of the bobbin body 30 as shown in FIG. 6 (Example A), can also be provided on the wide-width inner circumference surfaces 36A3 and 36A4 (Example B), or can also be provided both on the narrow-width inner circumference surfaces 36A1 and 36A2 and on the wide-width inner circumference surfaces 36A3 and 36A4 (Example C) of the bobbin body 30. However, in consideration of more effectively suppressing the breakage of the core 20, Example A of Examples A-C is the most preferred. The reasons will be explained as follows: In Example A, (1) when the impact is applied to the antenna device 10, the slight movement component on the XY surface shown in FIG. 6, along which the core 20 can slightly move so as to mitigate the impact force, can increase; and (2) the mechanical durability and strength in a wide-width side direction (in the Y-direction in FIG. 6) are larger than the mechanical durability and strength in a narrow-width side direction (in a direction that is perpendicular to paper in FIG. 6 (the Z-direction)) of the core 20.

Further, the core holding projections 37 can also be continuously provided or can also be discretely provided along the circumferential direction R of the inner circumference surface 36. Further, when the core holding projection 37 is cut at the surface (the XY surface in FIG. 6) that is perpendicular to the circumferential direction R and that is parallel to a height direction of the core holding projection 37, the cross-sectional shape of the core holding projection 37 is not particularly limited. However, when a tip of the core holding projection 37 is formed as a flat surface that is parallel to the inner circumference surface 36, as a width of the flat surface increases, this configuration shows a tendency in which the slight movement of the core 20 is limited or becomes more difficult. In the antenna device 10 in the embodiment according to the present invention, the core holding projections 37 are provided along the circumferential direction R. For the same reason explained above, because the core 20 cannot slightly move, the embodiment in which the core holding projection 37 of the antenna device 10 is provided along the longitudinal direction that is perpendicular to the circumferential direction R (or the axis direction C, or the X-direction) is not preferred.

Figure 7A:
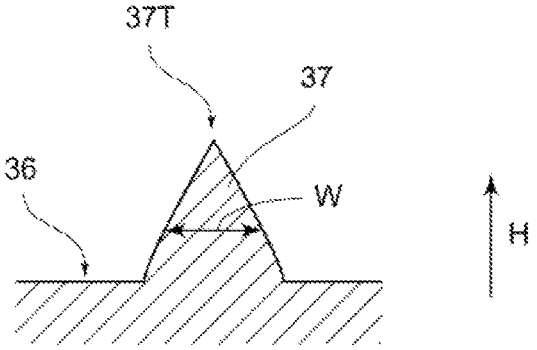
FIGS. 7A, 7B, and 7C are plan views that show configurations of core holding projections according to an embodiment of the present invention. Specifically.
Figure 7B:
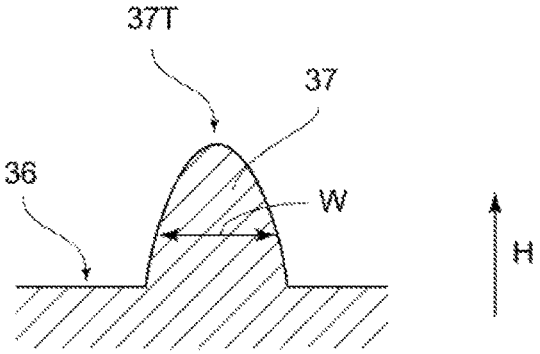
Figure 7C:
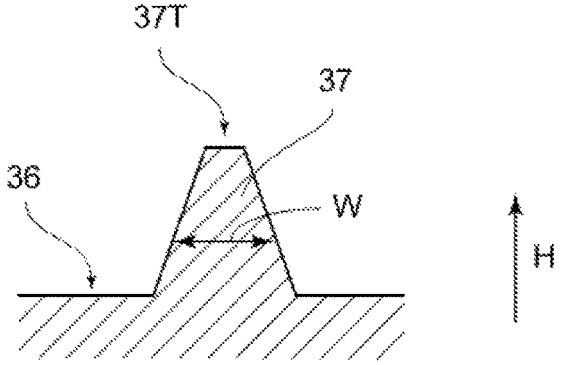

Therefore, as shown in FIGS. 7A-7C, in regards to the core holding projection 37, it is preferred that has the cross-sectional shape in which a length W in the width direction of part in the vicinity of a tip 37T of the core holding projection 37 as a cross-sectional shape becomes smaller toward the tip 37T from the inner circumference surface 36. Specifically, the width direction W corresponds to a length in the direction being perpendicular to the height direction H of the core holding projection 37. As the cross-sectional shape explained above, for instance, a triangular sectional shape (FIG. 7A), a semielliptical sectional shape (FIG. 7B) and a trapezoid shape of which the tip side has a small area (FIG. 7C) can be exemplified and used.

Further, an opening 38 is also provided at the bobbin body 30. The opening 38 is formed so as to make the end side of the core 20 move freely when the falling impact is applied. Therefore, in the configuration shown in FIG. 4, the opening 38 is provided in a state in which an upper surface side of the part, at which the end of one side of the core 20 (the end of the X1 side) in the longitudinal direction of the bobbin body 30 is provided, is opened. However, the opening 30 can also be provided in a state in which a lower surface side of the part, at which the end of one side of the core 20 (the end of the X1 side) is provided, is opened. Further, the opening 30 can also be provided in a state in which at least one surface of the narrow-width inner circumference surfaces 36A1 and 36A2 is opened.

Figure 9:
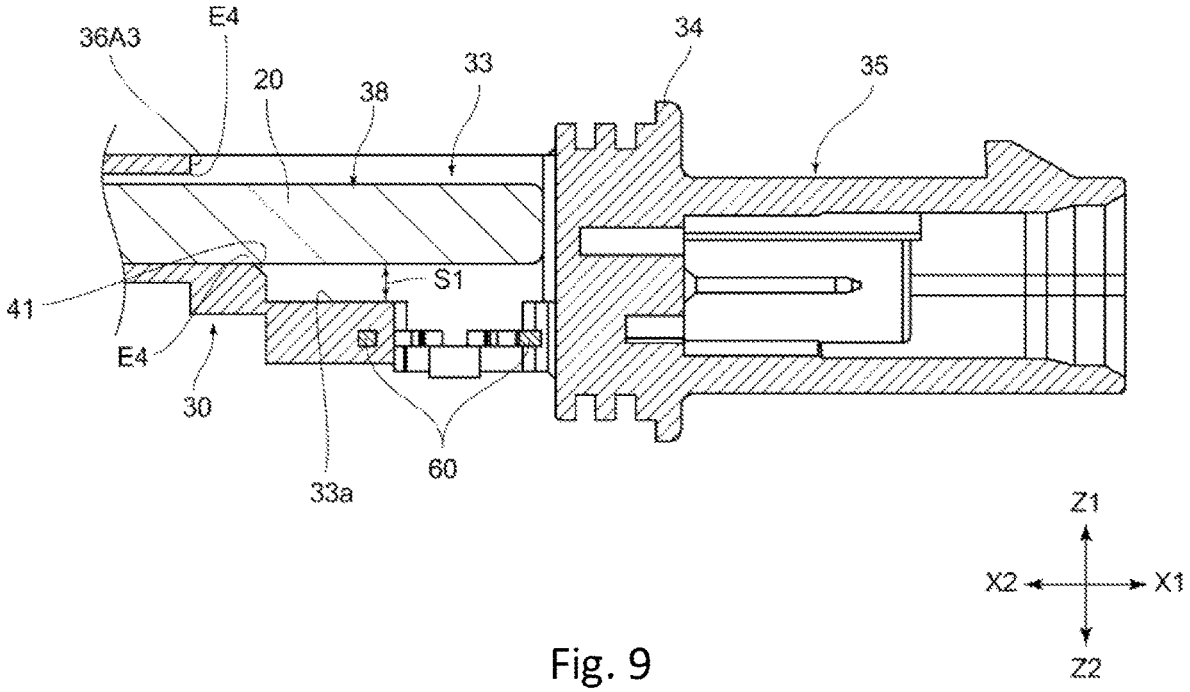
FIG. 9 is an enlarged cross sectional side view that shows a configuration in the vicinity of a terminal mounting part in regards to the antenna device shown in FIG. 3.

The core 20 is not placed directly on the terminal mounting part 33 and can also be placed in a state in which there is a slight gap therebetween. The configuration explained above is shown in FIG. 9. FIG. 9 is an enlarged side cross sectional view in the vicinity of the terminal mounting part 33 in regards to the antenna device 10 shown in FIG. 3. As shown in FIG. 9, a gap S1 exists between an upper surface 33A of the terminal mounting part 33 and the core 20. That is, the core 20 does not directly contact the upper surface 33A.

Because the gap S1 exists, the core 20 can move or slightly move toward the upper surface 33A. As a result, as compared with a case in which the core 20 is directly placed on the upper surface 33A, when the antenna device 10 is fallen down, the direct transmission of such falling impact to the core 20 can be mitigated and the breakage of the core 20 can be reduced.

As shown in FIG. 9, the opening 38 and the gap S1 are provided so as to sandwich the core 20 in the Z-direction. Further, in order to form the gap S1, a step 41 is formed on a side of the upper surface 33*a* and at the other end side (the X2 side) of the terminal mounting part 33 of the wide-width inner circumference surface 36A3 of the bobbin body 30. Because the step 41 exists, when the impact force is applied from outside, the core 20 can slightly move in a space in which the opening 38 and the gap S1 exist in the vertical direction (the Z-direction) with respect to an edge E4 of the step 41 or an edge E4 of the wide-width inner circumference surface 36A3 as a fulcrum. Therefore, the impact force can be mitigated. Further, as explained below, when a filler material such as a resin is filled in the gap S1, the impact force can be mitigated due to an elastic force of the filler material.

It is preferred that a dimension of the gap S1 is more than 0.5 mm. When the antenna device 10 is fallen down and when the gap S1 is smaller than 0.5 mm, it is easy for the core 20 to collide with the upper surface 33*a*. In order to prevent a dimension/size of the antenna device 10 from enlarging wastefully, it is preferred that the dimension of the gap S1 is equal to or less than 1.5 mm.

Figure 10:
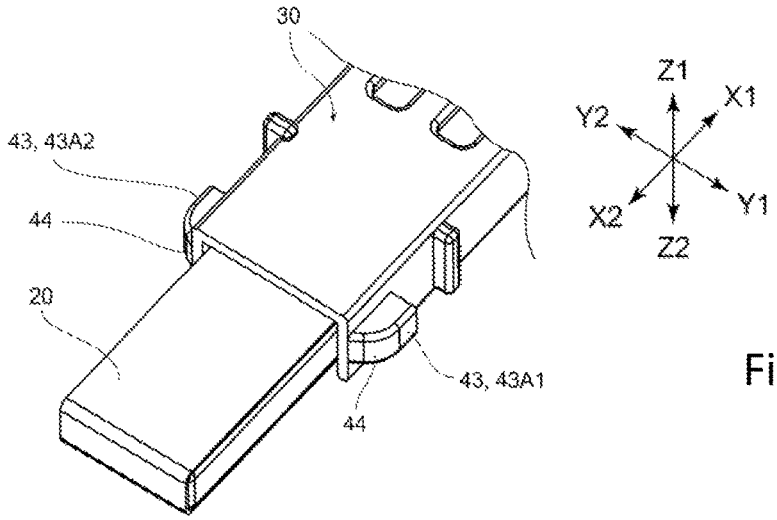
FIG. 10 is a perspective view that shows a configuration in the vicinity of a fitting projection on a tip side of a bobbin body according to an embodiment of the present invention.
Figure 11:
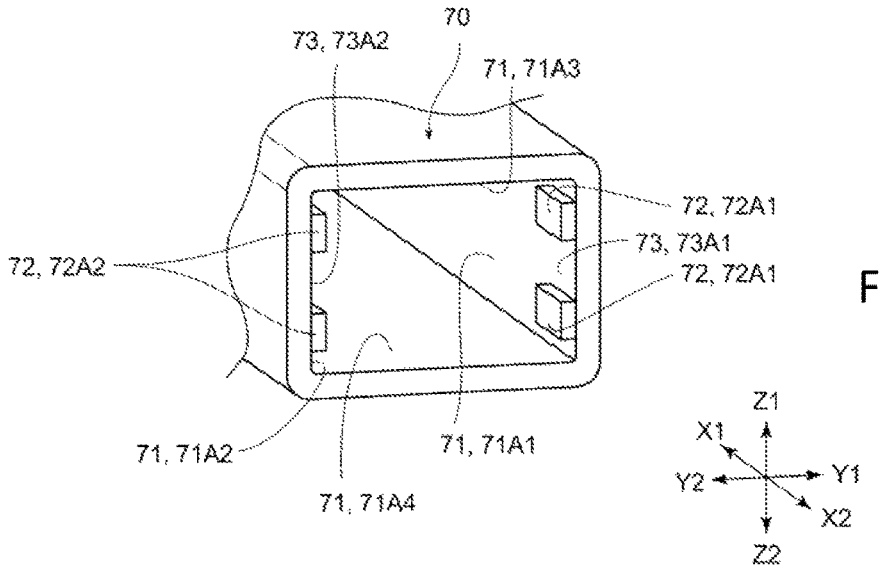
FIG. 11 is a perspective view that shows a configuration of a case that has a projection part according to an embodiment of the present invention.
Figure 12:
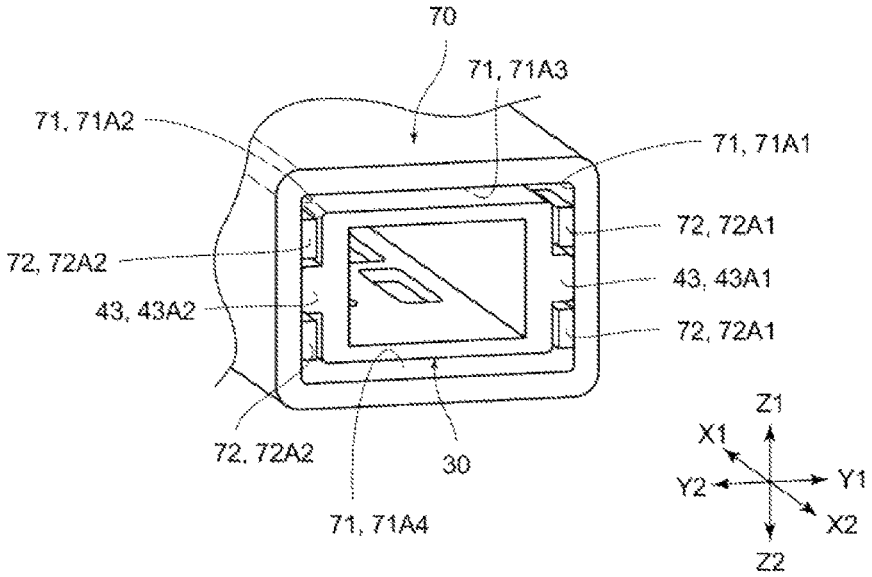
FIG. 12 is a perspective view that shows the fitting structure of the case shown in FIG. 11 and the bobbin body.

Next, a fitting structure for the bobbin body 30 and the case 70 will be explained below. FIG. 10 is a perspective view that shows a configuration in the vicinity of fitting projections 43 on a tip side of the bobbin body 30. FIG. 11 is a perspective view that shows a configuration of the case 70 that has projection parts 72. FIG. 12 is a perspective view that shows the fitting structure for the case 70 shown in FIG. 11 and the bobbin body 30 shown in FIG. 10.

As shown in FIGS. 11 and 12, a pair of projection parts 72 (projection parts 72A1 and 72A2) is respectively provided on two opposite surfaces of an inner circumference surface 71 of the case 70. In the configurations shown in FIGS. 11 and 12, the pair of projection parts 72 is located on a pair of opposite surfaces of the inner circumference surface 71 that is selected from the narrow-width inner circumference surfaces 71A1 and 71A2 and the wide-width inner circumference surfaces 71A3 and 71A4. Specifically, the narrow-width inner circumference surfaces 71A1 and 71A2 are parallel to each other and narrower than the wide-width inner circumference surfaces 71A3 and 71A4. The wide-width inner circumference surfaces 71A3 and 71A4 are parallel to each other and wider than the narrow-width inner circumference surfaces 71A1 and 71A2. Further, the two projection parts 72 are provided at a predetermined distance for each surface of the inner circumference surface 71.

In the configurations shown in FIGS. 11 and 12, each of the projection parts 72 is a rectangular parallelepiped and a cross section of each of the projection parts 72 is in a rectangular shape. Further, two of the projection parts 72 (the pair of projection parts 72) are provided in parallel. However, the projection part 72 can also be any shape other than the rectangular parallelepiped. For instance, its cross section can also be in a triangular shape, a semicircular shape, a semielliptical shape, or other shapes. Further, each of the projection parts 72 is provided so as to be parallel to the longitudinal direction (the X-direction). In the configurations shown in FIGS. 11 and 12, in regards to the projection parts 72, a pair that is located on the narrow-width inner circumference surface 71A1 is defined as the projection parts 72A1 and a pair that is located on the narrow-width inner circumference surface 71A2 is defined as the projection parts 72A2.

As shown in FIG. 11, fitting recess parts 73 (fitting recess parts 73A1 and 73A2) are formed between the pairs of projection parts 72 that are located as explained above. The fitting projection 43 that is explained below is fitted into the fitting recess part 73. That is, the fitting recess part 73 is located between the pair of projection parts 72. Further, a tip side of the fitting projection 43 is surrounded by the pair of projection parts 72 and the inner circumference surface 71 that is located between the pair of projection parts 72.

Therefore, because the fitting projection 43 is located in the fitting recess part 73 that is surrounded by the pair of projection parts 72 and the inner circumference surface 71, the holdability for the fitting projection 43 can be improved.

As the part being fitted into the fitting recess parts 73 explained above, the fitting projections (fitting projections 43A1 and 43A2) are provided at the bobbin body 30 as shown in FIG. 10. The fitting projections 43 are located at the other end side (the X2 side) of the bobbin body 30 in the longitudinal direction (the X-direction) and provided along the longitudinal direction (the X-direction). Further, in the configurations shown in FIGS. 10 and 12, a cross section of each of the fitting projections 43 is in a rectangular shape. In the following explanation, in regards to the fitting projections 43, the fitting projection 43 that is located on one side (the Y1 side) of the bobbin body 30 in the width direction (the Y-direction) is defined as the fitting projection 43A1 and the fitting projection 43 that is located on the other side (the Y2 side) of the bobbin body 30 in the width direction (the Y-direction) is defined as the fitting projection 43A2.

As shown in FIG. 10, a curved part 44 that is curved as approaching the other end side (the X2 side) is provided at the fitting projection 43. Therefore, when the fitting projection 43 is inserted into the fitting recess part 73, the insertion can be easily performed by the curved part 44 as an insertion guide. However, the shape of the fitting projection 43 is not limited to the shape shown in FIG. 10. The fitting projection 43 can be in other shapes. For instance, the fitting projection 43 can be a rectangular parallelepiped. In addition, a cross section of the fitting projection 43 can also be in a triangular shape, a semicircular shape, a semielliptical shape, or other shapes other than a rectangular shape.

When a thickness of the fitting projection 43 is thin (small), it is possible that the fitting projection 43 can have a spring property. Therefore, the thickness (a dimension in the Z-direction) of the fitting projection 43 is preferred to be thinner. Further, the thickness of fitting projection 43 is preferred to be thinner than a thickness of the projection part 72. Further, it is specifically preferred that the thickness of fitting projection 43 is less than half of the thickness of the projection part 72. In this case, because the core 20 can slightly move in the vertical direction (the Z-direction) in the fitting recess part 73 due to the thickness of the fitting projection 43, the collision impact of the antenna device 10 can be mitigated.

In the configurations shown in FIGS. 11 and 12, slight gaps exist between the projection parts 72 and the fitting projections 43. This is because one end side (the X1 side) of the bobbin body 30 is supported by the case 70 and the other end side (the X2 side) of the bobbin body 30 is held in a state in which the slight movement can be freely performed. However, the fitting projection 43 may directly contact at least one of the projection parts 72.

Outer circumference surfaces of the fitting projections 43 in the width direction (the Y-direction) directly contact the narrow-width inner circumference surfaces 71A1 and 71A2. However, the outer circumference surfaces of the fitting projections 43 in the width direction (the Y-direction) may not directly contact the narrow-width inner circumference surfaces 71A1 and 71A2 so that there are slight gaps therebetween.

When the configurations shown in FIGS. 10 and 12 are adopted, areas of the bobbin body 30, which are not directly contacted to the inner walls of the case 70, are significantly decreased. Further, as shown in FIG. 3, the tip of the other side (the X2 side) of the core 20 that is not held by the bobbin body 30 is completely free. That is, there is no support (such as a rib) for supporting the tip of the other side (the X2 side) of the core 20 between the case 70 and such tip. In addition, because a clearance K1 in the X-direction and clearances K2 and K3 in the Z-direction exist as shown in FIG. 3, there is a space that completely makes the tip of the core 20 free. Therefore, even when the antenna device 10 is fallen down, the impact becomes difficult to be directly transferred to the bobbin body 30, and as a result, the possibility of the breakage of the core 20 can be reduced.

When the entire of the projection parts 72 contacts the fitting projection 43 and when the integrated assembly that is configured with the bobbin body 30 and core 20 is inserted in the case 70, the other end side (the X2 side) of the bobbin body 30 and the core 20 is fixed. In this case, because the static fraction force between the outer circumference surface of the fitting projection 43 and the inner wall surface of the fitting recess part 73 is generated, the position of the bobbin body 30 is fixed. Therefore, an outside dimension of the fitting projection 43 can be designed by focusing the target pressure values of the fitting projection 43 and the fitting recess part 73 to achieve the sufficient static fraction force therebetween. For instance, the outside dimension of the fitting projection 43 can be designed to be larger than the fitting recess part 73 or the contact areas can also be enlarged.

In the fitting state explained above, the bobbin body 30 is held in the case 70 in a state in which the contact areas between the outer circumference surface of the bobbin body 30 and the wide-width inner circumference surfaces 71A3 and 71A4 of the case 70 are small. Therefore, when the antenna device 10 is fallen down, the bobbin body 30 can slightly move in the case 70. Therefore, because the falling impact toward the core 20 can be mitigated in two steps, i.e., the case 70 and the bobbin body 30, the damage of the core 20 can be significantly reduced.

Further, a configuration, in which a projection that is narrower than the fitting projection 43 and the projection part 72 and a tip side of the projection is easily deformed, can also be adopted as at least one of the fitting projection 43 and the projection part 72. In this case, the bobbin body 30 can be elastically held, and as a result, it becomes possible that the impact force being transmitted to the core 20 via the bobbin body 30 can be mitigated.

Here, a clearance L1 (corresponding to a first clearance) between the outer circumference surface (an outer circumference side surface) of the tip fitting part 32 of the bobbin body 30 and the projection part 72 is considered by a diameter of the wire 52 of the coil 50. That is, for instance, when the coil 50 is formed by winding the wire 52 in two wound layers (two rounds), a sum of two times of the diameter of the wire 52 and a predetermined gap corresponds to the clearance L1. When the coil 50 is formed by winding the wire 50 in one wound layer (one round), a sum of the diameter of the wire 52 and the predetermined gap corresponds to the clearance L1. In any case, the dimension of the clearance L1 is larger than the diameter of the wire 52. Further, it is preferred that the predetermined gap is more than the diameter of the wire 52. However, the predetermined gap can be equal to or less than the diameter of the wire 52 or can also be more than the diameter of the wire 52.

Further, a clearance L2 (corresponding to a second clearance) between the outer circumference surface (an outer circumference bottom surface) of the tip fitting part 32 of the bobbin body 30 and the wide-width inner circumference surface 71A4 can be the same as the clearance L1, can be more than the clearance L1, or can also be less than the clearance L1 explained above.

Next, a lightweight structure (a lightened structure) of the case 70 will be explained below. The falling impact of the antenna device 10 is, in general, related to a mass and a speed of a falling object. Here, when the antenna device 10 is fallen down from a predetermined height, because a landing speed is substantially determined by a gravitational acceleration, a parameter that can be controlled is only the mass of the falling object. That is, the less the mass of the falling object is, the less kinetic energy and the impact force are. Based on these issues, as part of the decrease of the mass of the antenna device 10, a configuration for reducing the weight of the case 70 is considered.

However, when the weight of the case 70 is simply reduced, there is a possibility that the strength of the case 70 is deteriorated by the weight reduction. Therefore, in consideration of the above problems relating to the weight reduction of the case 70, a configuration, in which the mass of the case 70 is decreased while maintaining the strength of the case 70, is achieved.

Figure 13:
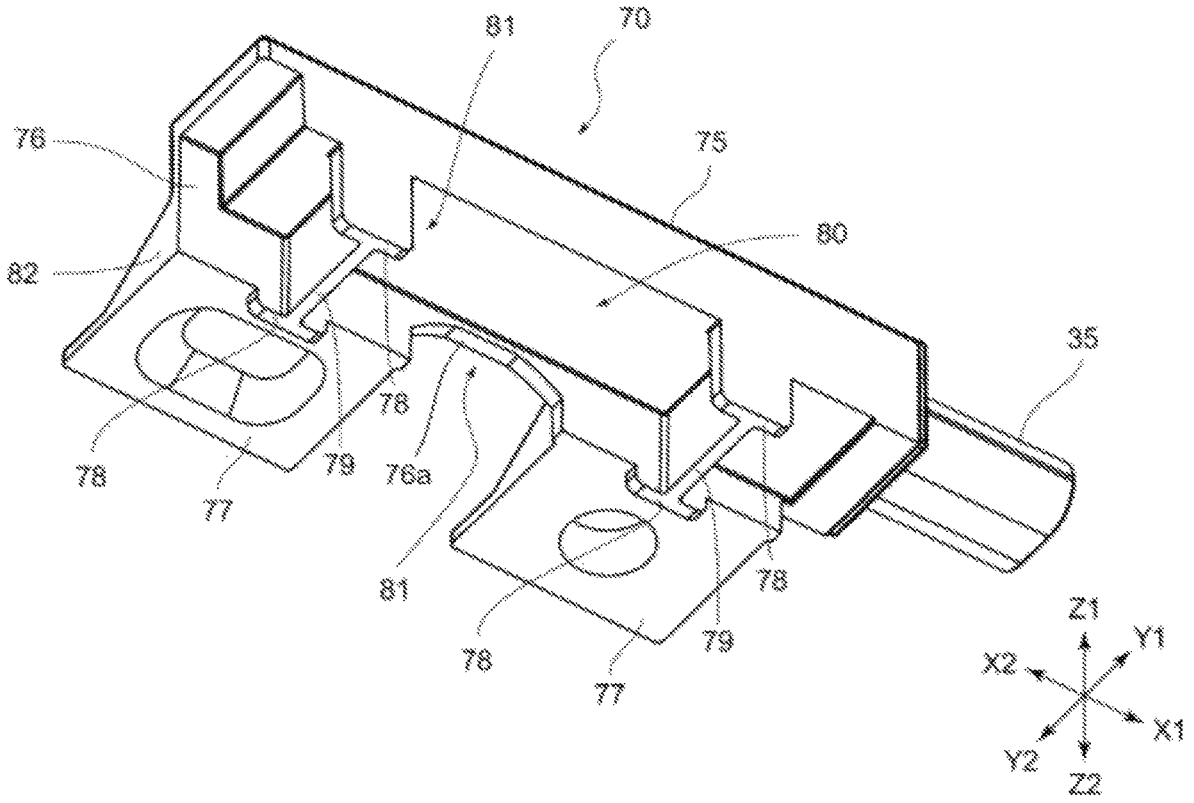
FIG. 13 is a perspective view that shows a state in which a case is viewed from a lower side according to an embodiment of the present invention.

FIG. 13 is a perspective view that shows a state in which the case 70 is viewed from a lower side (the Z2 side). As shown in FIG. 13, the case 70 is configured with a storage part 75, a side surface extension part 76, an outside attaching part 77, a raising part (riser) 78, and a beam 79. Further, all of the side surface extension part 76, the outside attaching part 77, the raising part 78, and the beam 79 are resin plates that have a respective predetermined thickness.

The storage part 75 is a tubular part in which the integrated assembly that is configured with the core 20, the bobbin body 30, and the coil 50 is housed. Further, the side surface extension part 76 extends from an outer circumference side surface of the tubular storage part 75 and is integrally continuous to a part of the outside attaching part 77 and a part of the raising part 78 explained below.

Further, the outside attaching part 77 is for fixing the case 70 to external equipment. The case 70 is fixed to the external equipment such as a part of a vehicle body via the outside attaching part 77 by, for instance, using a bolt. Further, the raising part 78 is provided for separating the integrated assembly inside the base 70 from a mounting location, such the part of the vehicle body by a predetermined distance. Because the raising part 78 exists, the integrated assembly explained above can be separated from a conductive part of the vehicle body by the appropriate distance.

The beam 79 connects a pair of raising parts (risers) 78, and as a result, the strength on a side of the raising parts 78 can be improved. It is preferred that a thickness of the beam 79 is the same as a thickness of the raising part 78. However, these thicknesses can also be different from each other. Because this beam 79 exists, a warp and a deformation in the width direction (the Y-direction) of the raising part 78 and the side surface extension part 76 can be prevented. As a result, the strength of the case 70 can be preferably improved. It is preferred that the beam 79 is provided at a center part of the raising part 78 in the width direction (the Y-direction). However, the beam 79 can be provided at other positions of the raising part 78.

The raising part 78 is provided so as to be parallel to the outer circumference side surface of the storage part 75. In the configuration shown in FIG. 13, the raising part 78 is provided so as to be flush with the outer circumference side surface of the storage part 75. On the other hand, the beam 79 is provided so as to be perpendicular to the raising part 78. Therefore, in this configuration, the strength of the case 70 can be preferably improved while reducing the amount of the resin that is required for forming the raising part 78 and the beam 79.

As shown in FIG. 13, with respect to a side of a lower surface of the case 70, the resin portion that exists from the lower surface of the storage part 75 throughout the lowermost side (the end side of the Z2 side) of the case 70 is only the raising part 78 and the beam 79. The other parts are not formed with thick resin configurations that are made by filling the resin as much as possible. Thus, the other parts are configured by combining plate-shaped resin members (the side surface extension part 76, the outside attaching part 77, the raising part 78, and the beam 79) so that the lightweight structure can be obtained. Therefore, the weight of the case 70 can be significantly reduced.

Here, in the conventional configuration, a part corresponding to a lightened part 80 according to the embodiment of the present invention is a solid resin portion that is continuously provided from the storage part 75 throughout the lower end side of the raising part 78. As a result, the weight of the case 70 is larger by solid resin portion part in the conventional configuration than the configuration according to the embodiment of the present invention. When comparing the conventional thick structure explained above with the configuration according to the embodiment of the present invention, in regards to the case 70, the large lightened part 80 is provided between a pair of beams 79 that are apart in the longitudinal direction (the X-direction). In addition, the side surface extension part 76 that is located between the pair of beams 79 is removed, and as a result, a window part 81 is provided between two separated side surface extension parts 76. Therefore, the weight of the case 70 can be significantly reduced. As a result, because the falling kinetic energy of the antenna device 10 becomes small and the impact force is mitigated, the damage of the core 20 can be reduced.

Further, on the upper end of the lightened part 80 on the other side (the Y2 side) in the width direction (the Y-direction), a remaining part **76*a* in which the side surface extension part 76 is slightly left is provided. As a result, the remaining part 76*a* can prevent the case 70 from deforming or curving in the longitudinal direction (the X-direction) so that the strength of the case 70** can be preferably improved.

In the configuration shown in FIG. 13, some of the raising parts 78 are integrally formed with the side surface extension parts 76. However, a configuration, in which the raising parts 78 that are integrally formed with the side surface extension parts 76 are omitted, can also be adopted. Further, a mounting surface of the external equipment, on which the outside attaching part 77 is attached, may not be flush. Therefore, because the raising parts 78 being integrally formed with the side surface extension parts 76 are provided, it becomes possible that the outside attaching part 77 avoids the roughness of the mounting surface of the external equipment. Further, when the case 70 is attached on the external equipment, it is preferred that the outside attaching part 77 is not deformed by the attachment stress.

In order to the prevent the deformation of the outside attaching part 77, a reinforcing part (rib) 82 shown in FIG. 13 can also be provided. The reinforcing part 82 is a triangular area connecting the outside attaching part 77 to the side surface extension part 76. Because the reinforcing part 82 is provided, even when the stress is applied during the attachment, the deformation of the outside attaching part 77 can be prevented. Further, the reinforcing part 82 is provided so as to be perpendicular to the surface of the outside attaching part 77, and in addition, is provided so as to also be perpendicular to the outer circumference side surface of the storage part 75. As a result, while reducing the amount of the resin that is required, it becomes possible that the deformation of the outside attaching part 77 is excellently prevented. Further, in the embodiment of the present invention, the reinforcing parts 82 are provided at a pair of edges of (a pair of edges in the longitudinal direction (the X-direction)) on the surface of the outside attaching part 77, respectively (only the reinforcing part 82 exists at one side edge shown in FIG. 13). Therefore, the configuration in which the outside attaching part 77 is hardly deformed can be obtained.

In FIG. 12, the fitting structure of the fitting recess part 73 and the fitting projection 43 at the other end side (the X2 side) in the longitudinal direction (the X-direction) is shown. However, the same fitting structure of the fitting recess part 73 and the fitting projection 43 can also be provided on one side (the X1 side) in the longitudinal direction (the X-direction). Further, the same fitting structure of the fitting recess part 73 and the fitting projection 43 can also be provided only one side (the X2 side) in the longitudinal direction (the X-direction).

Figure 14:
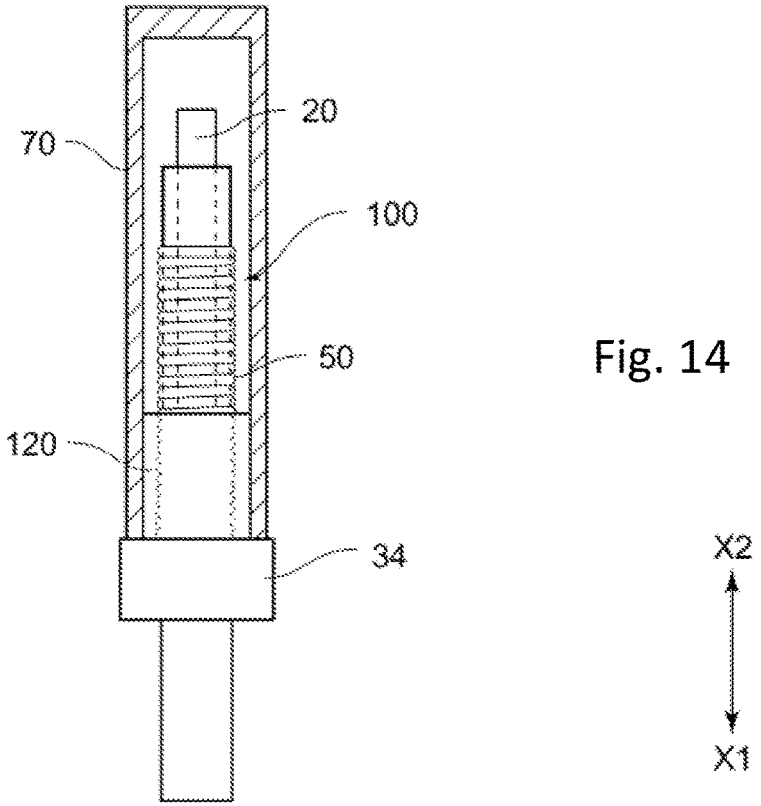
FIG. 14 is a schematic view that shows a configuration of an antenna device according to a second embodiment of the present invention.

Next, a filling structure of the resin will be explained below. FIG. 14 is a schematic view that shows a configuration of the antenna device 10 according to a second embodiment of the present invention. Further, because FIG. 14 is the schematic view that shows the configuration of the antenna device 10, the detailed configurations can be the same as the antenna device 10 according the first embodiment explained above.

In the antenna device 10 according to the second embodiment, as shown in FIG. 14, a side of an opening 70*a* of the case 70 at which the flange part 34 is located is sealed by a cured resin part 120. Because that part is sealed by the cured resin part 120, a waterproof structure in which liquid such as water can be prevented from entering into the case 70 can be realized.

Further, an integrated assembly that is configured with the core 20, the bobbin body 30, the coil 50, and the connector connection part 35 is held at one end side (the X1 side) of the case 70 in the longitudinal direction (the X-direction) inside of the case 70. A structure that is configured with such as the core 20, the bobbin body 30, and the coil 50 is referred to as an integrated assembly 100 in the following explanations.

Figure 15:
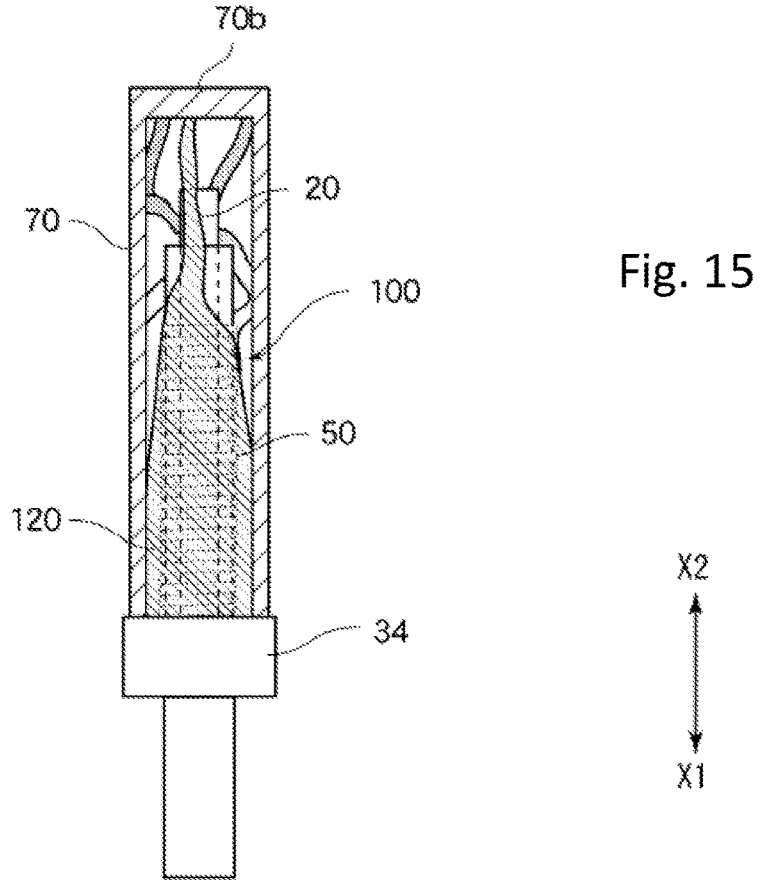
FIG. 15 is a schematic view that shows an example in which a cured resin part is cured according to the antenna device shown in FIG. 14.

Further, as shown in FIG. 14, the cured resin part 120 is not often cured evenly at the side of the flange part 34. An example in which the cured resin part 120 explained above is evenly cured is shown in FIG. 15. FIG. 15 shows that a liquid filler 110 (see, for example, FIGS. 17A-17C) is cured so as to be the cured resin part 120. As shown FIG. 15, the cured resin part 120 forms a cured member (a hatched part in the case 70) that is non-uniform and columnar.

In FIG. 15, a part of the columnar cured member reaches and is connected to the other end bottom part 70*b*. However, the cured resin part 120 is fixed to the case 70 mainly on the side of the flange part 34 (the X1 side) in the longitudinal direction (the X-direction). Because the cured resin part 120 that is connected to the other end bottom part 70*b* can also fix the core 20 to the case 70, a free movement of the core 20 can be suppressed. Further, the cured resin part 120 in this part (the other end bottom part 70*b*) does not completely fill in the other end bottom part 70*b* of the case 70. In other word, the cured resin part 120 in this part is connected between the core 20 and the case 70 (in particular, the other end bottom part 70*b*) via lots of spaces (void) in the shape like so-called tree branches. As a result, for instance, when the case 70 is fallen down, the falling impact force that is transferred from the other end bottom part 70*b* of the case 70 can be prevented from directly hitting the end of the core 20 so that it is possible that the breakage of the core 20 can be reduced. Note, however, that when the falling impact force for the core 20 is desired to be more reduced, a space ratio (a void ratio) in this part should further increase. Further, a configuration in which the end of the core 20 can completely and freely swing (so as to be a free end) can also be adopted.

Further, part of the cured resin part 120 that is located between a small amount of the cured resin part 120 that is located at the other end bottom part 70*b* of the case 70 and the cured resin part 120 that is located at one end side (i.e., the side of the flange part 34) has a low density as compared with the remaining of the cured resin parts 120 that are located at the other end bottom part 70*b* and at one end side (the side of the flange part 34), and is substantially provided only on the surface of the coil 50. In other words, as compared with the cured resin parts 120 that are located at the other end bottom part 70*b* and at one end side (the side of the flange part 34), much more spaces (the voids) are provided between the part of the cured resin part 120 that is located between these both ends cured resin parts 120 explained above and the inner wall surface of the case 70.

Further, the cured resin part 120 can also cover (coat) at least a part of the integrated assembly 100 on one side (the X1 side) or the other side (the X2 side) in the longitudinal direction (the X-direction).

As explained above, the integrated assembly 100 is held at one end side (the X1 side) of the case 70 in the longitudinal direction (the X-direction) in the case 70. Therefore, as shown in FIGS. 3 and 4, it is not necessary that the integrated assembly 100 is held at the other end side (the X2 side) of the case 70 in the longitudinal direction (the X-direction). That is, the fitting structure (a suspension structure) of the bobbin body 30 and the case 70 shown in FIGS. 11 and 12 may not be required. Thus, the integrated assembly 100 can be supported by so-called a cantilever state. However, the both sides of the integrated assembly 100 can also be supported by providing the fitting structure of the bobbin body 30 and the case 70.

When the fitting structure of the bobbin body 30 and the case 70 is not provided, the integrated assembly 100 is held by the cured resin part 120 on one side (the X1 side) in the vicinity of the flange part 34 in the longitudinal direction (the X-direction). That is, in regards to the integrated assembly 100, the fixed end that is fixed to the case 70 on the side of the flange part 34 (the X1 side; one side) in the longitudinal direction (the X-direction) is provided. On the other hand, the free end that is not fixed to the case 70 on the other side (the X2 side; an opposite to the X1 side) in the longitudinal direction (the X-direction) is provided. Therefore, the other side (the X2 side: the side of the free end) of the bobbin body 30 is in the free state (not being held by any member) so that it becomes possible that the falling impact of the antenna device 10 is released by the slight movement of the bobbin body 30 and the core 20 on the other side (the X2 side).

Further, a method of manufacturing the antenna device 10 is explained below.

First Process: Preparation of the Case 70 and the Integrated Assembly 100

Figure 16:
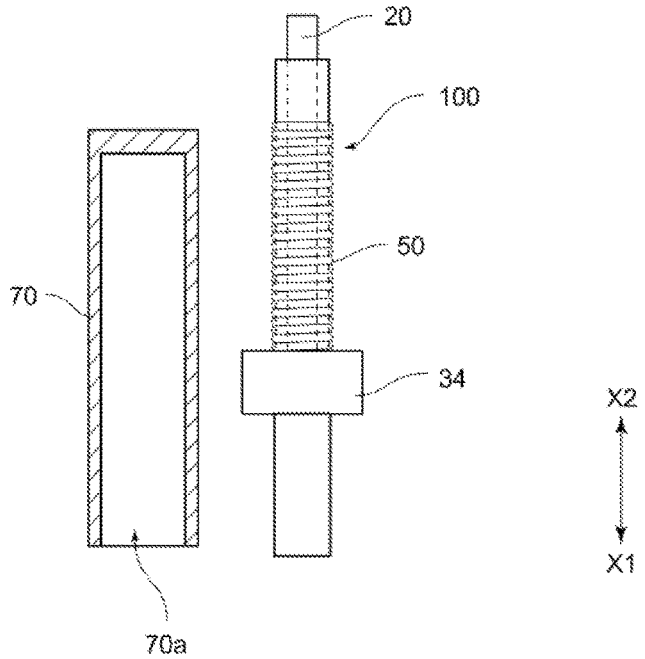
FIG. 16 is a schematic view that shows a case and an integrated assembly to form the antenna device according to the second embodiment of the present invention.

FIG. 16 is a schematic view that shows the case 70 and the integrated assembly 100 for manufacturing the antenna device 10 according to the embodiment of the present invention. As shown in FIG. 16, in order to manufacture the antenna device 10 according to the embodiment of the present invention, the tubular case 70 and the integrated assembly 100 that is configured with such as the core 20, the bobbin body 30, the coil 50, and the connector connection part 35 are prepared. That is, the integrated assembly 100 is formed in advance (corresponding to an integrated assembly formation process).

Second Process: Injection of the Liquid Filler 110

Figures 17A, 17B, 17C:
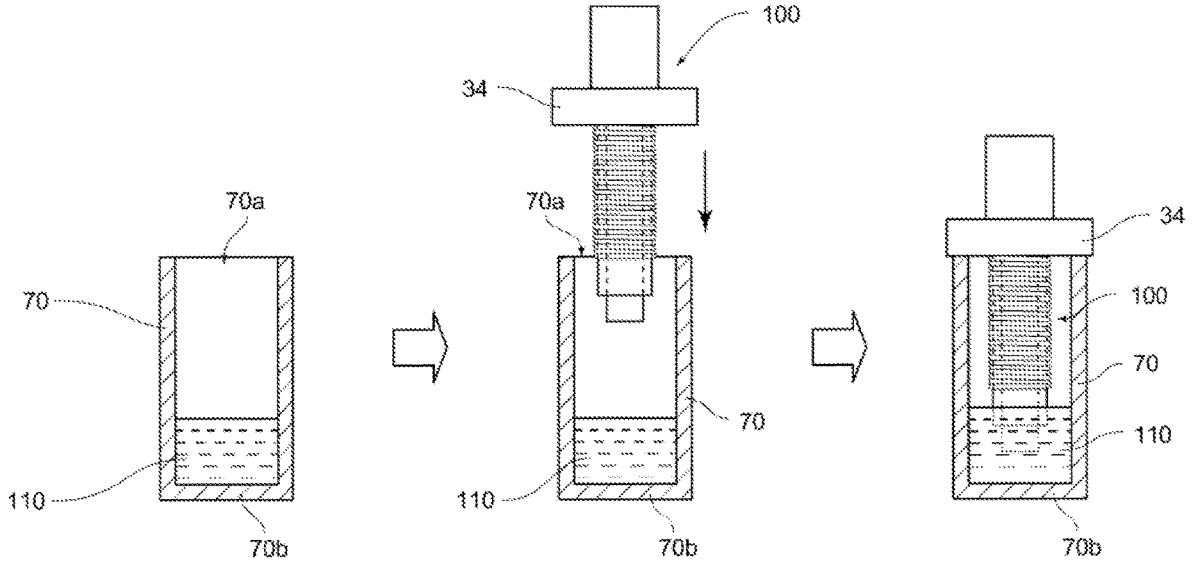
FIGS. 17A, 17B, and 17C are schematic views that show states in which a liquid filler is injected and an integrated assembly is attached according to an embodiment of the present invention. Specifically.

FIGS. 17A-17C are schematic views that show states in which the liquid filler 110 is injected and the integrated assembly 100 is attached to the tubular base 70. Specifically, FIG. 17A is a diagram that shows a state in which the liquid filler 110 is injected inside the case 70. FIG. 17B is a diagram that shows a halfway stage of inserting the integrated assembly 100 into an inside of the case 70. Further, FIG. 17C is a diagram that shows a state in which the insertion of the integrated assembly 100 inside of the case 70 is completed. As shown in FIG. 17A, as a first step, an opening 70*a* of the case 70 is located at an upper side in the vertical direction (the opening 70*a* of the case 70 is located at an upper side with respect to horizontal). In other words, the other end bottom part 70*b* that is located on the other end side (the X2 side) of the case 70 in the longitudinal direction (the X-direction) is located at a lower side in the vertical direction (the other end bottom part 70*b* is located at a lower side with respect to horizontal).

After the case 70 is positioned in the state explained above, as shown in FIG. 17A, the liquid filler 110 is injected inside the case 70 (corresponding to a liquid filler supply process). An amount of the injected liquid filler 110 can be smaller than or equal to a capacity (inner volume) of an interior space of the case 70. That is, the amount of the liquid filler 110 is adjusted so as not to be overflowed from the interior space of the case 70. Further, the amount is preferred to be smaller than half of the capacity (inner volume) of the interior space of the case 70. Here, it is preferred that the liquid filler 110 is injected from the other end bottom part 70*b* up to substantially one fifth of the entire length of the inside of case 70. Further, the liquid filler 110 can be a two-liquid mixture filler and can also be a thermosetting filler.

Further, the liquid filler 110 is preferred to relatively have high viscosity as compared with such as water. The reason is that, when the liquid filler 110 has high viscosity, even if the liquid filler 110 adheres in gaps of the coil 50 or the other part, it does not flow downward easily and is cured while that liquid filler 110 stays. However, the liquid filler 110 can also be relatively have high fluidity.

As a material for the liquid filler 110 explained above, for instance, an epoxy resin, a phenol resin, a melamine resin, a urea resin, an unsaturated polyester resin, a polyimide resin, a furan resin, a polybutadiene resin, an ionomer resin, an EEA resin, an acrylonitrile acrylic styrene resin (an ASA resin), an acrylonitrile-styrene resin (AS resin), an acrylonitrile-chlorinated polyethylene-styrene resin (ACS resin), ethylene-vinyl acetate copolymer, an ethylene-vinyl alcohol copolymer resin, an acrylonitrile-butadiene-styrene resin (ABS resin), a vinyl-chloride resin, a chlorinated polyethylene resin, a cellulose acetate resin, a fluorocarbon resin (fluororesin), a polyacetal resin, a polyamide resin such as polyamide resins 6, 66 or polyamide resins 11, 12, a polyarylate resin, a thermoplastic polyurethane elastomer, liquid crystal polymer, polyether ether ketone, a polysulfone resin, a polyether sulfone resin, high density polyethylene, low density polyethylene, linear low-density polyethylene, polyethylene terephthalate, a polycarbonate resin, a polystyrene resin, a polyphenylene ether resin, a polyphenylene sulfide resin, a polypropylene resin, a methacrylic resin, and methylpentene polymer can be used.

Further, as a material for the (liquid) filler 110 explained above, a rubber material such as diene rubber and non-diene rubbers, various kinds of resins, a glass, a texture, a paper and a lumber can be used. Specifically, the diene rubber is such as natural rubber, isoprene rubber, butadiene rubber, and styrene-butadiene rubber. The non-diene rubber is such as butyl rubber, ethylene-propylene rubber, urethane rubber, and silicone rubber. The various kinds of resins are such as a polyolefin resin, a polyester resin, a polyether resin, a polyurethane resin, a polysiloxane resin, an acrylic resin, and a polyvinylchloride resin. Also, a natural fiber and a polylactic resin can also be used because of considering the global environment and having a low impact on the environment. Further, from the viewpoint of the lightness, a styrene foam, a honeycomb structure body having the high porosity, a corrugated structure, and a grating structure can also be used.

The urethane rubber having elasticity among the materials mentioned above is the most suitable. Specifically, the urethane rubber has good adhesiveness with respect to, for instance, PBT (polybutylene terephthalate) or the other various resins that are used as the material of the case 70. Therefore, as compared with a case in which silicone rubber or fluorocarbon rubber (fluororubber) is used, the cured resin part 120 becomes hardly peeled off. Further, because the urethane rubber has elasticity, when the integrated assembly 100 is held by the cured resin part 120, such as at the time of falling of the antenna device 10, the falling impact can also be excellently absorbed by slightly and relatively slowly moving the integrated assembly 100. Further, the cured resin part 120 that is made of such as the urethane rubber can also cover at least a part of the surfaces of the integrated assembly 100 as a coating film. As a result, the direct collision of the integrated assembly 100 to the inner wall of the case 70 can also be prevented. That is, when the liquid filler 110 flows downward along the integrated assembly 100, the film-like cured resin part 120 is formed at least a part of the integrated assembly 100, and as a result, the integrated assembly 100 can be protected from the impact.

Third Process: Insertion of the Integrated Assembly 100

Next, as shown in FIG. 17B, the integrated assembly 100 is inserted into the case 70. At this time, as shown in FIG. 17C, the integrated assembly 100 is inserted until the opening 70*a* of the case 70 is closed by the flange part 34, and at the same time, the opening 70*a* is surely sealed by the flange part 34 (corresponding to an integrated assembly insertion process). At this time, the case 70 is not fully filled with the liquid filler 110. Rather, only less than half of (the inner volume of) the interior space of the case 70 is filled with the liquid filler 110.

Fourth Process: Overturn of the Case 70 and the Integrated Assembly 100

Figure 18A:
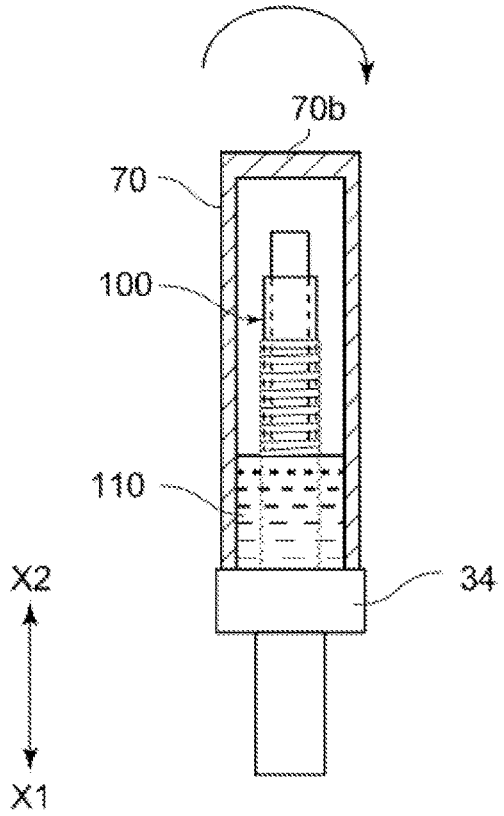
FIGS. 18A and 18B are schematic views that show a state in which the antenna device is formed by overturning the case and the integrated assembly shown in FIG. 17C according to the embodiment of the present invention. Specifically.
Figure 18B:
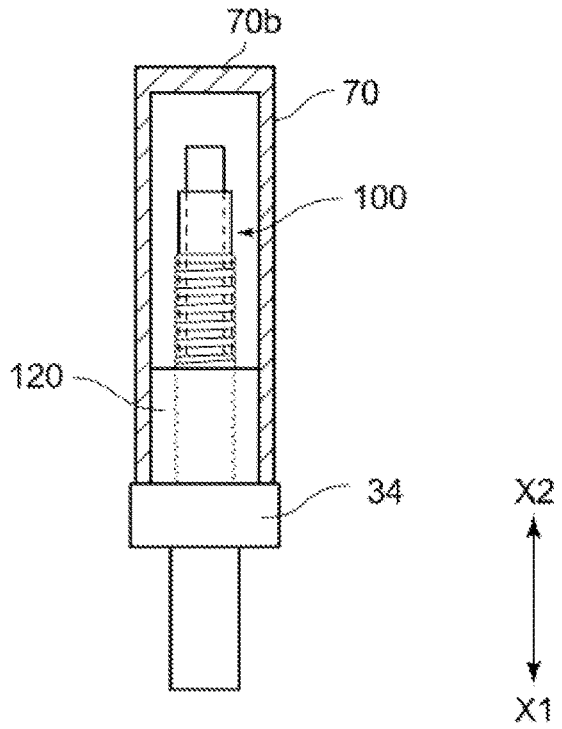

FIGS. 18A and 18B are diagrams that show states in which the antenna device 10 is formed by overturning the case 70 and the integrated assembly 100 shown in FIG. 17C. FIG. 18A is the diagram that shows a state in which the liquid filler 110 is accumulated downward by being overturned. FIG. 18B is the diagram that shows a state in which the liquid filler 110 is cured and the cured resin part 120 is formed. After the state shown in FIG. 17C, as shown in FIG. 18A, the case 70 and the integrated assembly 100 are overturned at 180 degrees at the same time (corresponding to a turning process). That is, the side of the opening 70*a* of the case 70 is located at the lower side in the vertical direction (the side of the opening 70*a* is located at the lower side with respect to horizontal) compared to the other end bottom part 70*b* of the case 70. As explained above, when the case 70 and the integrated assembly 100 are overturned at the same time, because the case 70 is not fully filled with the liquid filler 110, the liquid filler 110 is about to flow downward. At this time, during the process in which the liquid filler 110 flows downward, the liquid filler 110 invades into a part of the gaps of the coil 50, covers a part of the surface of the coil 50 or the bobbin part 31 (the bobbin body 30), or invades into a part of a clearance between the coil 50 and bobbin body 30 or a part of a clearance between the bobbin body 30 and the core 20. Further, when the liquid filler 110 has high viscosity, some of the liquid filler 110 stay there mentioned above. Therefore, not all of the liquid filler 110 flows downward. As a result, relative positions among the three of the core 20, the bobbin body 30, and the coil 50 can also be fixed.

When the case 70 and the integrated assembly 100 are overturned, it is preferred that the rotation is performed until a state in which the longitudinal direction (the X-direction) of the case 70 having a long shape is along the vertical direction and that the cured resin part 120 can also be formed in such state. However, after the rotation of the case 70 and the integrated assembly 100 can be performed until a state in which the longitudinal direction (the X-direction) of the case 70 having the long shape is slightly deviated from the vertical direction, the cured resin part 120 can also be formed in such state.

Fifth Process: Curing the Liquid Filler 110

Next, for instance, the liquid filler 110 is cured for approximately 10 minutes to 60 minutes (corresponding to a curing process). If the liquid filler 110 is made of a two-liquid mixture filler, the curing is started at the moment of mixing two-types of liquid fillers. If necessary, the curing process can also be accelerated by heating to a suitable temperature. After this curing is completed, as shown in FIG. 18B, the antenna device 10 having the cured resin part 120 is formed. Because the case 70 of the antenna device 10 has the cured resin part 120 occupied at a level where approximately one fifth from the other end bottom part 70*b* of the case 70, a portion in the case 70 where the integrated assembly 100 does not exist at the upper side than the cured resin part 120 is a space. Because the space explained above exists, it is possible that the filler content of the liquid filler 110 is reduced as compared with the conventional configurations and processes.

Further, the method of manufacturing that is explained above with reference to the FIGS. 17A-17C and 18 can also be changed to other method of manufacturing as shown in FIGS. 19A, 19B, and 21-22. A variation of this method of manufacturing will be explained below.

Figure 19A:
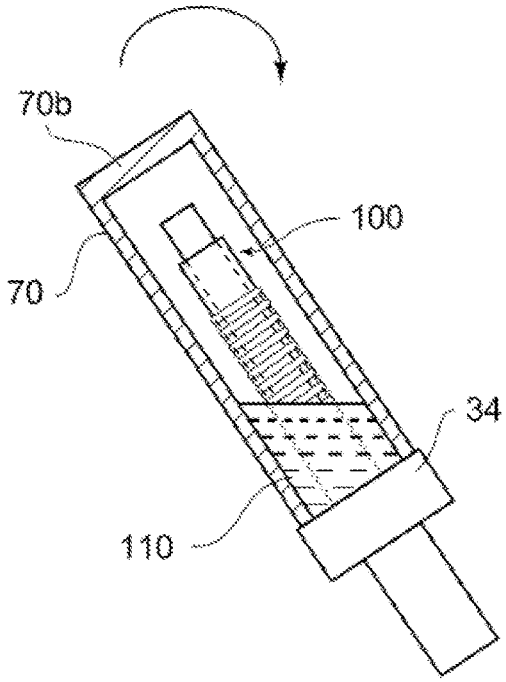
FIGS. 19A and 19B are schematic views of an antenna device according to a variation of the embodiment of the present invention.
Figure 19B:
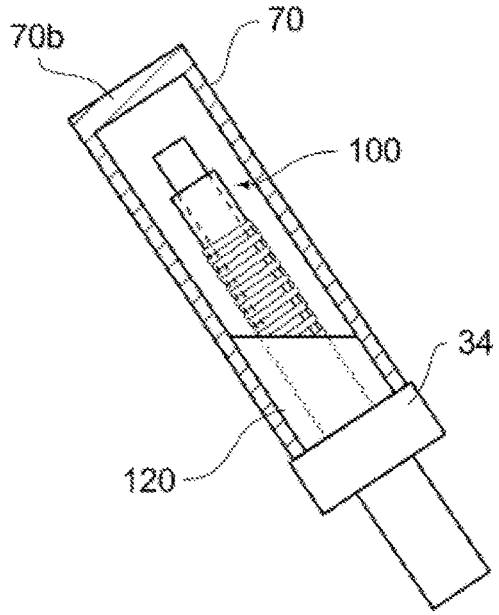

When the case 70 and the integrated assembly 100 are overturned at the same time, the case 70 and the integrated assembly 100 can also be inclined only at an arbitrary degrees within an angle range of 90 degrees to 180 degrees instead of being overturned at 180 degrees. FIGS. 19A and 19B are diagrams that show an example for the variation mentioned above. FIG. 19A is the diagram that shows a state in which the liquid filler 110 is injected in the inclined case 70 and the inclined antenna device 10 in which an opening 70*a* faces downward in the vertical direction. FIG. 19B is the diagram that shows a state in which the liquid filler 110 is cured.

As shown in FIGS. 19A and 19B explained above, in contrast to the FIGS. 17 and 18, the cured resin part 120 can also be obtained by inclining the case 70 and the integrated assembly 100 and fixing the liquid filler 110. As explained above, because the case 70 and the integrated assembly 100 are inclined, an area in which the core 20, the bobbin body 30, and the coil 50, etc. are soaked into the liquid filler 110 can be increased so that the ability for fixing the relative positions of these components can be improved. Here, as shown in FIGS. 19A and 19B, when the case 70 and the integrated assembly 100 are inclined, an entire length of an inside of the case 70 is defined as 100, and the surface (the surface of the X2 side) of the other end side (the X2 side) of the flange part 34 is defined as a starting point of the entire length. In the state mentioned above, it is preferred that 60 percent of the volume of the liquid filler 110 (the cured resin part 120) is located at up to between the position 20 and the position 30. However, when the case 70 and the integrated assembly 100 are not inclined, it is preferred that the entire volume of the liquid filler 110 is located at between the position 20 and the position 40.

Further, in FIG. 19A, the liquid filler 110 is cured in the state in which the case 70 and the integrated assembly 100 are inclined. As a result, when it is raised to the position in which the longitudinal direction (the X-direction) of the case 70 is along the vertical direction, an interface (a top surface) of the cured resin part 120 located in the inside of the case 70 is inclined relative to the horizontal while the interface (the top surface) of the cured resin part 120 maintains to be a planar as shown in FIG. 19B. However, it is not necessary that the interface (the top surface) of the cured resin part 120 maintains to be the planar. For instance, the interface (the top surface) explained above can also be irregular or uneven such as a wave surface.

Figure 20:
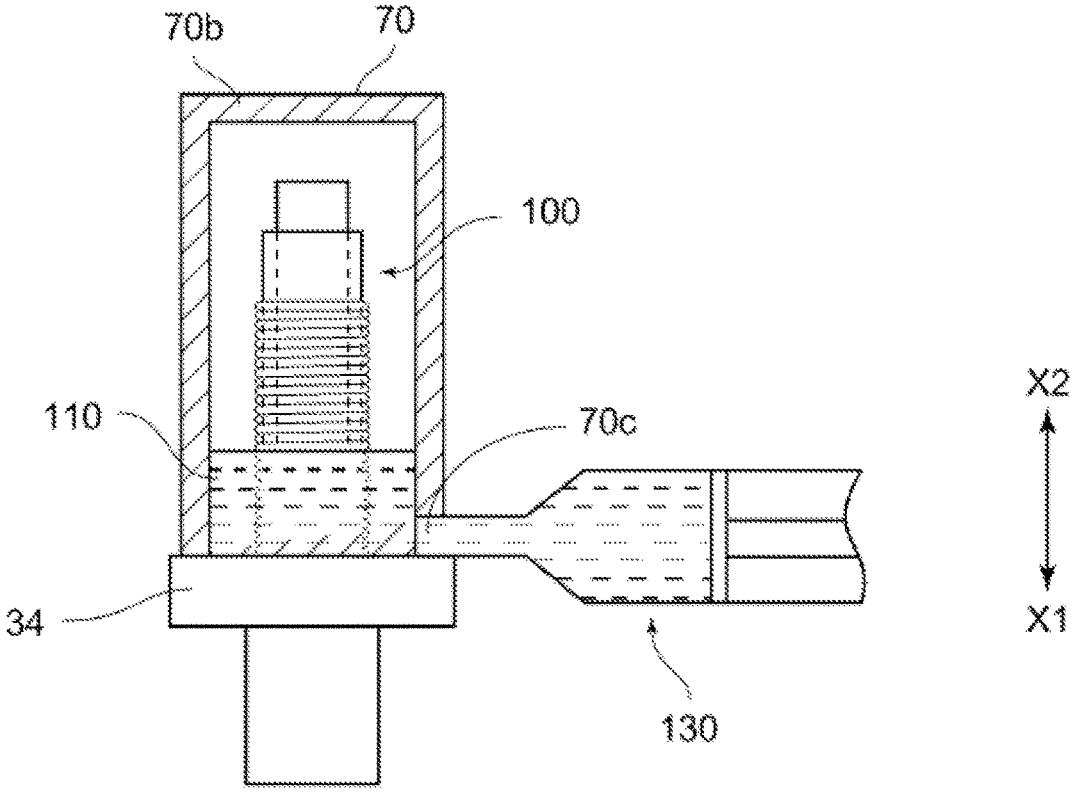
FIG. 20 is a schematic view that shows a state in which a liquid filler is injected inside a case by using a dispenser according to a variation of the embodiment of the present invention.

Further, it is not necessary that the liquid filler 110 is injected from the opening 70*a* of the case 70. For instance, as shown in FIG. 20, by providing an inlet port (injection port/hole or filler port/hole) 70*c* that fluidly communicates with the inside of the case 70, the liquid filler 110 can be injected via the injection port 70*c*. In this case, as shown in FIG. 20, the liquid filler 110 can be injected inside the case 70 by using a dispenser 130 as an exclusive injection device for injecting the liquid filler 110 and inserting a tip of the dispenser 130 into the injection port 70*c*.

Here, in the configuration shown in FIG. 20, the injection port 70*c* is provided on a side surface of the case 70 located directly adjacent to the opening 70*a* of the case 70. However, the injection port 70*c* can be provided on the side surface of the case 70 at any arbitrary position between the opening 70*a* and the other end bottom part 70*b* in the longitudinal direction (the X-direction) of the case 70. Further, the injection port 70*c* can be provided at any position in the other end bottom part 70*b*.

FIG. 20 shows the state in which a liquid surface of the liquid filler 110 is parallel to the horizontal surface while the longitudinal direction (the X-direction) of the case 70 is along the vertical direction. However, the liquid surface of the liquid filler 110 can be inclined or in an irregular shape depending on the viscosity of the liquid filler 110 or an ambient member arrangement.

FIG. 20 shows the state in which the tip of the dispenser 130 is inserted into the injection port 70*c* so that the liquid filler 110 is injected into the inside of the case 70. However, the cured resin part 120 can be partially formed inside the case 70 by using a method other than the method of using the dispenser 130. For instance, the cured resin part 120 can be formed in a part of the inside of the case 70 by using the same method as an injection molding. Further, the cured resin part 120 can be formed in the part of the inside of the case 70 by using the same method as a transfer molding.

In the case in which the same method as the injection molding or the transfer molding explained above is used, because the dispenser 130 is not used, i.e., the tip of the dispenser 130 is not inserted into the injection port 70*c*, contrivances are needed in regards to a position on the case 70 at which the injection port 70*c* is formed or the size of the injection port 70*c*. For instance, a technique of a secondary molding can be used. In this case, a part of the liquid filler 110 is injected in the vicinity of the injection port 70*c* that is formed larger as compared with the case in which the tip of the dispenser 130 is inserted. As a result, the liquid filler 110 enters into the inside of the case 70. Thereafter, a rest of the liquid filler 110 is supplied so that the opening of the injection port 70*c* is sealed. When the secondary molding explained above is performed, there is a case in which a part, where the opening part of the injection port 70*c* exists, is projected, i.e., an outer surface outwardly rises at the time of supplying the latter (remaining) liquid filler 110.

Further, when the antenna device 10 is attached to an external equipment, there is a case in which a pool of water is formed in the vicinity of the injection port 70*c* or the water intrudes into the inside of the case 70 via the injection port 70*c*. In order to prevent the formation of the pool of water in the vicinity of the injection port 70*c* or the intrusion of the water from the injection port 70*c*, it can be considered that the antenna device 10 is attached to the external equipment in a state in which the injection port 70*c* faces downward in the vertical direction.

Figure 21:
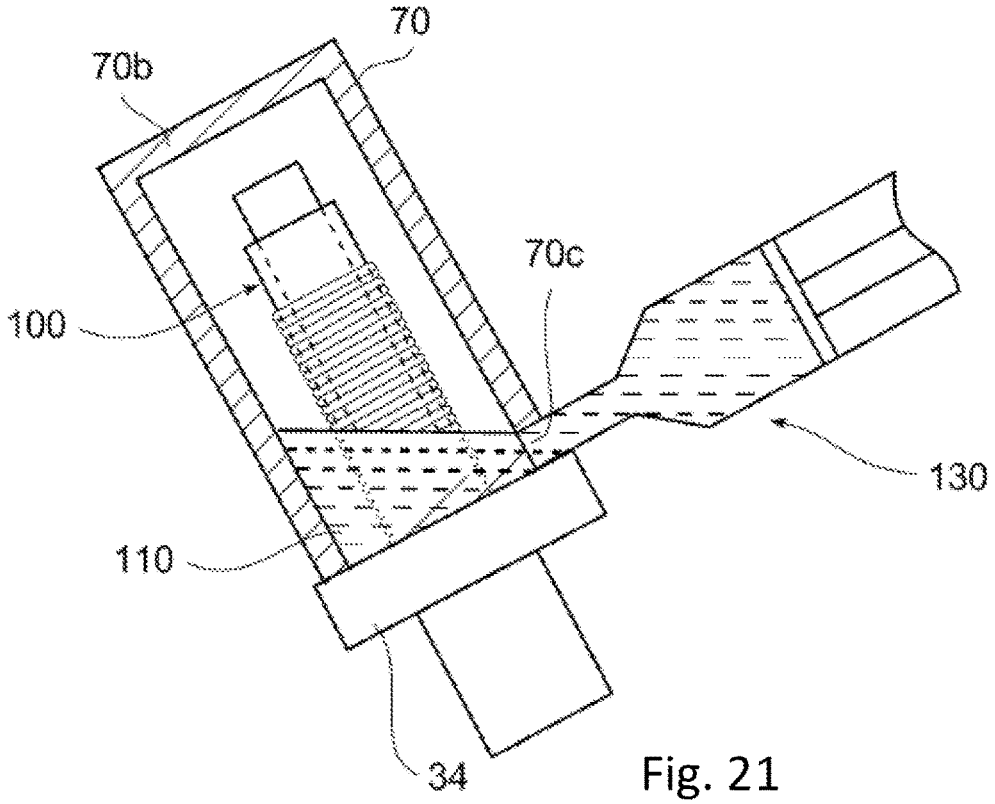
FIG. 21 is a schematic view that shows a state in which the liquid filler is injected from an inlet by using the dispenser while the case and the integrated assembly are inclined according to a variation of the embodiment shown in FIG. 20 of the present invention.

As shown in FIG. 21, the liquid filler 110 is injected from the injection port 70*c* when the case 70 and the integrated assembly 100 are inclined. Also in this case, in the same manner as shown in FIGS. 19A and 19B, an area in which the core 20, the bobbin body 30, and the coil 50, etc. are soaked into the liquid filler 110 can be increased so that the ability for fixing the relative positions of these components can be improved.

Further, in the state shown in FIG. 21, the liquid filler 110 is injected when the injection port 70*c* faces upward in the vertical direction. In this case, when the liquid filler 110 located inside the case 70 does not reach the injection port 70*c*, there is the following merit. Specifically, even when the tip of the dispenser 130 is removed from the injection port 70*c*, the liquid filler 110 does not leak from the injection port 70*c*. However, the liquid filler 110 can be injected from the injection port 70*c* by using the dispenser 130 when the injection port 70*c* is located on the lower side in the vertical direction (the injection port 70*c* is located on the lower side with respect to horizontal) as compared with the liquid surface of the liquid filler 110 located inside the case 70.

Figure 22:
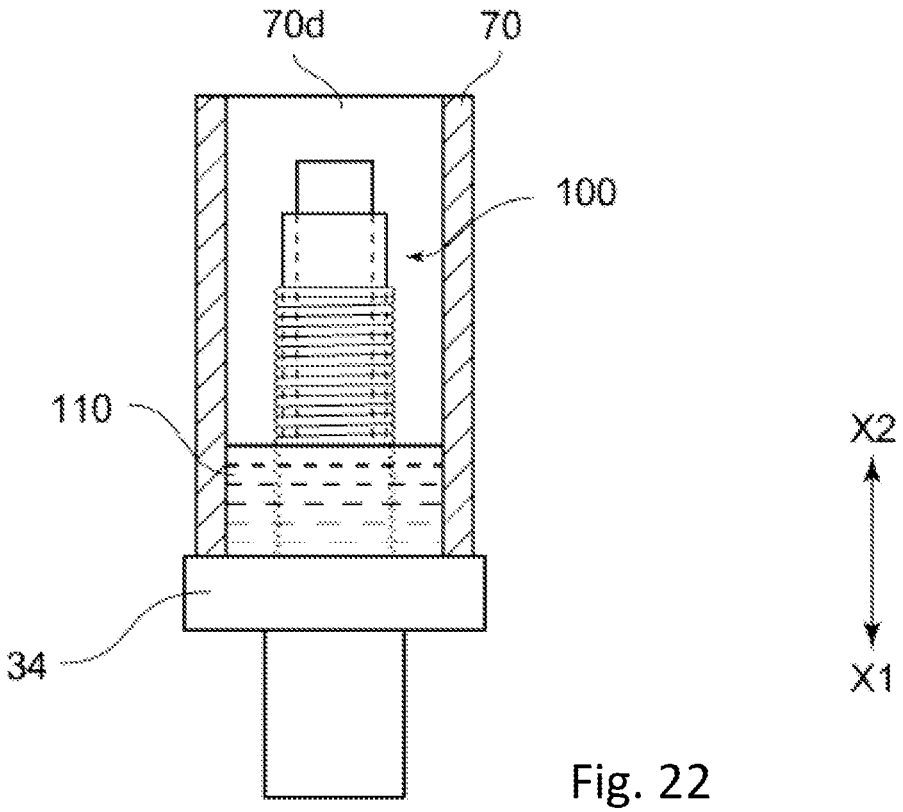
FIG. 22 is a schematic view that shows a state in which a liquid filler is injected in a tubular case in which the both sides are opened without having a bottom at one end according to a variation of the embodiment of the present invention.

Further, the liquid filler 110 can also be injected by using a case 70 that is different from the case 70 shown in, for example, FIG. 14. The different case 70 is shown in FIG. 22. FIG. 22 is a diagram that shows an image of injecting the liquid filler 110 by using the tubular case 70 in which both sides are opened without a bottom (such as the other end bottom part 70*b*) at the other end side (the X2 side). Thus, in the configuration of this case 70, a second opening 70*d* is provided at the other end side (the X2 side) of the case 70 in the longitudinal direction (the X-direction) other than the opening 70*a* that is provided at one end side (the X1 side) of the case 70 in the longitudinal direction (the X-direction).

Figure 23:
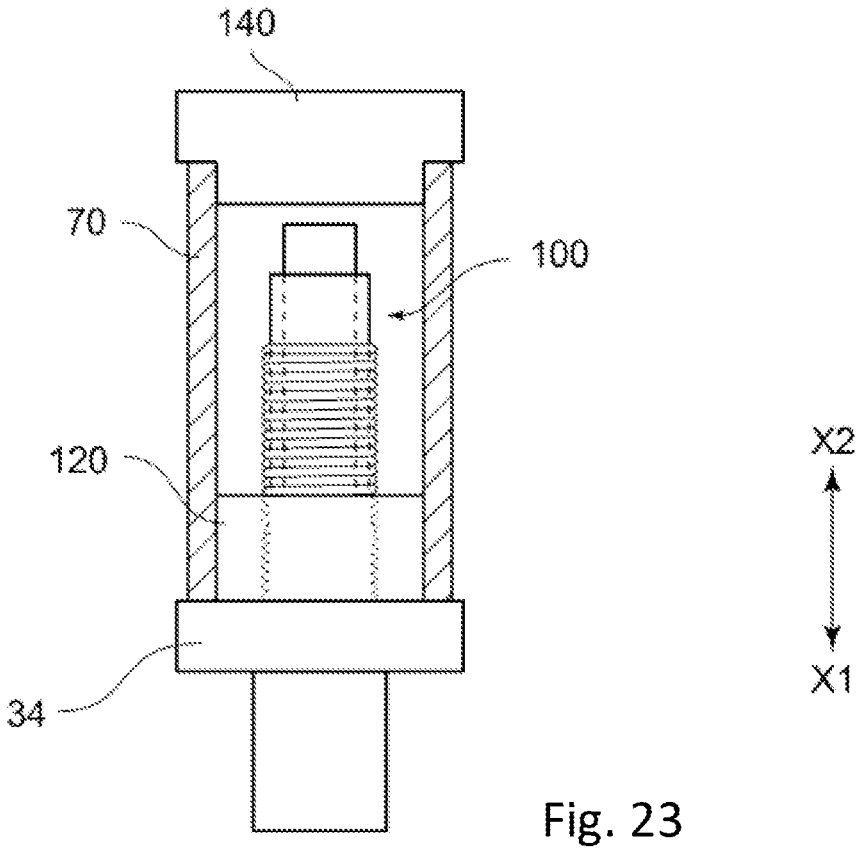
FIG. 23 is a schematic view that shows a state in which an antenna device is formed by attaching a lid member to one opening of the tubular case shown in FIG. 22.

When the case 70 (shown in FIG. 22) explained above is used, the integrated assembly 100 is inserted from a side of the opening 70*a* of the case 70. On the other hand, the liquid filler 110 is injected into the inside of the case 70 from a side of the second opening 70*d* of the case 70. Then, after the liquid filler 110 is cured so that the cured resin part 120 is formed, the second opening 70*d* is closed (sealed) by a lid member 140. FIG. 23 is a schematic view that shows a state in which the antenna device 10 is formed by attaching the lid member 140 to the case 70 shown in FIG. 22. In this case, because the liquid filler 110 can be injected into the inside of the case 70 from the second opening 70*d*, it is not necessary that the case 70 and the integrated assembly 100 are overturned.

Further, in regards to the antenna device 10 shown in FIG. 14 and the method of manufacturing the antenna device 10, the following can be performed. That is, the case 70 is prepared in advance. Further, an integrated assembly is formed by integrally assembling the bobbin body 30, the core 20, and the coil 50. Thereafter, the integrated assembly is inserted into the case 70. Then, after the liquid filler 110 is filled inside the case 70, the cured resin part 120 is formed.

Figure 24:
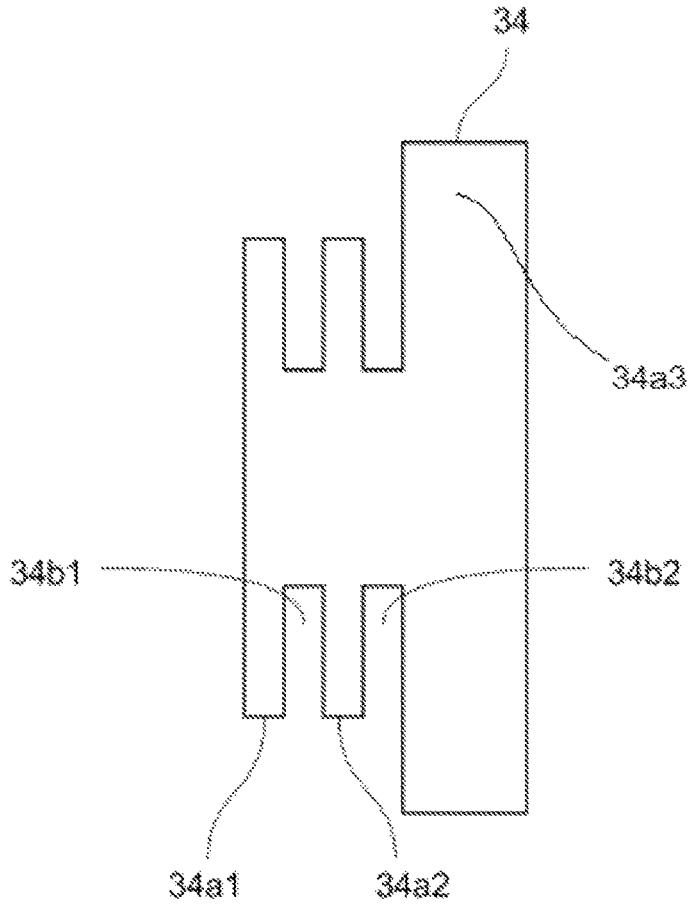
FIG. 24 is a schematic view that shows a configuration of a flange part according to a variation of the embodiment of the present invention.

Further, if it is achieved that the opening 70*a* is surely sealed and the leakage of the liquid filler 110 is prevented, the flange part 34 can be formed in a configuration shown in FIG. 24. The flange part 34 shown in FIG. 24 has projection (fin) parts 34*a*1 and 34*a*2 and recess parts 34*b*1 and 34*b*2. The fin parts 34*a*1 and 34*a*2 are outwardly projected to an outer diameter side as compared with the recess parts 34*b*1 and 34*b*2. Because the fin parts 34*a*1 and 34*a*2 are inserted into the inside of the opening 70*a* of the case 70, the leakage of the liquid filler 110 can be reduced.

That is, because the fin part 34*a*1 contacts the inside of the case 70, a first leakage prevention part for reducing the leakage of the liquid filler 110 is formed. However, when the liquid filler 110 is leaked beyond the fin part 34*a*1, the leaked liquid filler 110 is filled in the recess part 34*b*1. Thus, because it takes a longer time for filing the leaked filler into the recess part 34*b*1 compared with a case in which there is no recess part, it is effectively prevented the leaked filler from reaching an outside of the case 70. Further, because the fin part 34*a*2 contacts the inside of the case 70, a second leakage prevention part for reducing the leakage of the liquid filler 110 is formed. However, when the liquid filler 110 is leaked beyond the fin part 34*a*2, the leaked liquid filler 110 is filled in the recess part 34*b*2. Thus, because it takes a longer time for filing the leaked filler into the recess part 34*b*2 compared with a case in which there is no recess part, it is effectively prevented the leaked filler from reaching an outside of the case 70. In addition, eventually, because a flange base 34*a*3 having a larger diameter than the fin parts 34*a*1 and 34*a*2 contacts the opening edge of the opening 70*a*, a third leakage prevention part is formed. Therefore, because the first, second, and third leakage prevention parts exist in three stages, the leakage of the liquid filler 110 can be excellently reduced.

Further, the same configuration as the flange part 34 shown in FIG. 24 can be applied to the lid member 140 shown in FIG. 23.

Figure 25:
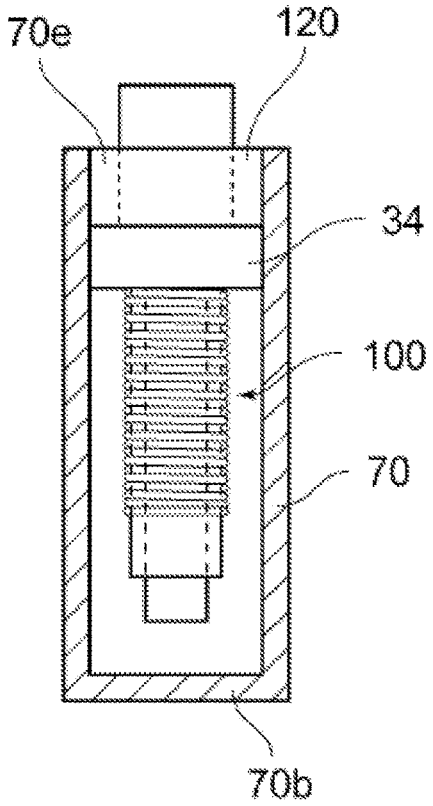
FIG. 25 is a schematic view that shows a configuration of an antenna device according to a variation of the embodiment of the present invention.

Further, in regards to the antenna device 10 shown in FIG. 14 and the method of manufacturing the antenna device 10, the following can be performed. Such alternate configuration is shown in FIG. 25. FIG. 25 is a schematic view that shows a configuration of the antenna device 10 according to a variation of the embodiment of the present invention. In the configuration shown in FIG. 25, the flange part 34 completely invades into the inside of the case 70, and a recess part 70*e* is provided at one end side (the X1 side) of the flange part 34 in the longitudinal direction (the X-direction) of the case 70. The liquid filler 110 is filled in the recess part 70*e*. Further, the cured resin part 120 is formed by curing the liquid filler 110 so that the opening of the case 70 is surely sealed by the cured resin part 120 in the recess part 70*e*.

Even with the configuration of the antenna device 10 shown in FIG. 25 explained above, the sealing property can be improved between the flange part 34 and the case 70 even while reducing the filler content of the liquid filler 110. Further, the manufacturing of the antenna device 10 can be easily performed.

Further, with respect to the configurations according to the second embodiment explained above, it is possible that the falling impact resistance of the antenna device 10 is preferably improved by combining with each configuration that is explained in the first embodiment.

Variation

In each of the embodiments of the present invention explained above, the configurations with only one core 20 are shown. However, a configuration in which the core 20 is divided into more than two can also be adopted.

Further, in the first embodiment of the present invention explained above, the bobbin body 30 is supported by the case 70 via the side of the flange part 34 and the side of the fitting projection 43. In other words, it is a support structure in which both ends are supported. However, the bobbin body 30 can also be supported by the case 70 in the cantilever state. That is, a configuration in which the bobbin body 30 is supported by only the flange part 34 without providing the fitting projection 43 and the fitting recess part 73 can be adopted. Further, a configuration in which the bobbin body 30 is supported by only the fitting projection 43 and the side of the fitting recess part 73 can also be adopted.

The method of manufacturing the antenna device and the antenna device being thus described, it will be apparent that the same may be varied in many ways. Such variations are not to be regarded as a departure from the spirit and scope of the invention, and all such modifications as would be apparent to one of ordinary skill in the art are intended to be included within the scope of the following claims.

What is claimed is:

1. A method of manufacturing an antenna comprising:

forming an integrated assembly that is configured with:

a core;

a bobbin disposed around the core, the bobbin having a flange; and a coil disposed around the bobbin;

preparing a case having an opening and a closed end that is located opposite to the opening;

supplying a liquid filler material into an inner space of the case;

inserting the integrated assembly into the inner space of the case via the opening before or after the supplying of the liquid filler material;

closing the opening with the flange;

locating the case at a first position where the opening is located lower than the closed end with respect to horizontal after the opening is closed by the flange;

concentrating the liquid filler material toward the flange in the inner space when the case is located at the first position;

curing the liquid filler material after the concentrating so as to form a cured filler material; and fixedly supporting the integrated assembly within the case via the cured filler material at a position directly adjacent to the opening of the case.

2. The method of manufacturing an antenna according to claim 1, further comprising:

supplying the liquid filler material into the case in an amount that is equal to or less than a half of an inner volume of the inner space of the case.

3. The method of manufacturing an antenna according to claim 1, in the supplying, locating the case at a second position where the closed end is located lower than the opening with respect to the horizontal, and supplying the liquid filler material into the inner space of the case before inserting the integrated assembly into the inner space of the case, in the inserting, when the case is located at the second position, the integrated assembly is inserted into the inner space of the case containing the liquid filler material via the opening, and after the opening is closed by the flange, rotating the case until the case is located at the first position.

4. The method of manufacturing an antenna according to claim 3, the liquid filler material is liquid urethane rubber, in the rotating, the case is rotated until the opening is located lower than the closed end, and the liquid urethane rubber is caused to flow along a periphery of the integrated assembly, and in the curing, covering at least part of the periphery of the integrated assembly with a film of cured urethane rubber.

5. The method of manufacturing an antenna according to claim 3, wherein, in the rotating, the case is rotated until substantially vertical, and the curing is performed while the case is substantially vertical.

6. The method of manufacturing an antenna according to claim 3, wherein, in the rotating, the case is rotated until the case is inclined relative to vertical, and the curing is performed while the case is inclined.

7. The method of manufacturing an antenna according to claim 1, wherein the case has an inlet through which the liquid filler material is supplied, and the supplying further comprises:

inserting a tip of a dispenser into the inlet, and thereafter supplying the liquid filler material into the inner space of the case via the dispenser.

8. An antenna comprising:

an integrated assembly that is configured with:

a core;

a bobbin disposed around the core, the bobbin having a flange; and a coil disposed around the bobbin;

a case housing the integrated assembly, the case having an opening at a first end and a closed end at a second end opposite to the first end, the flange closing the opening; and a cured filler material that is disposed directly adjacent to the flange in an inner space of the case, the cured filler material having an exposed surface in the inner space, the exposed surface facing toward the closed end of the case, wherein an amount of the cured filler material is equal to or less than a half of an inner volume of the inner space of the case, and the exposed surface of the cured filler material is parallel to or inclined to the flange.

9. The antenna according to claim 8, wherein the cured filler material is urethane rubber, and a film of the urethane rubber covers at least part of a periphery of the integrated assembly.

10. The antenna according to claim 8, wherein the flange has a fin and a recess, and the fin and the recess are disposed directly adjacent to each other, and the cured filler material is in the recess.

11. The antenna according to claim 8, wherein the bobbin has two pairs of opposite outer surfaces, and the case has two pairs of opposite inner surfaces, each of two opposite outer surfaces of one of the two pairs of opposite outer surfaces of the bobbin has a fitting projection, each of two opposite inner surfaces of one of the two pairs of opposite inner surfaces of the case has a fitting recess, the fitting projections are fit into the fitting recesses, and the other of the two pairs of opposite outer surfaces of the bobbin are spaced apart from the other of the two pairs of opposite inner surfaces of the case.

12. The antenna according to claim 11, wherein the fitting recess is configured with a pair of projections, and a tip of the fitting projection is nested within a cavity defined by the pair of projections and a bottom of the fitting recess.

13. The antenna according to claim 8, wherein a cross section of an inner surface of the bobbin is rectangular having four sides, and two opposite sides are longer than two other opposite sides, and a holding projection is disposed on the inner surface of the bobbin at one of the two opposite sides and the two other opposite sides, and the holding projection contacts an outer surface of the core.

14. The antenna according to claim 13, wherein a width of a tip of the holding projection is smaller than a width of a base of the holding projection.

15. The antenna according to claim 13, wherein the integrated assembly has a connection terminal to which a wire of the coil is connected, the core is elongated in a longitudinal direction, and the holding projection is located between the connection terminal and a longitudinal center of the core.

16. The antenna according to claim 13, further comprising:

a flange holding projection that is disposed on an inner surface of the flange facing the inner space, wherein an end of the core contacts the flange holding projection so that the end of the core is spaced apart from the inner surface of the flange.

17. The antenna according to claim 13, wherein the integrated assembly has a connection terminal to which a wire of the coil is connected, a terminal mount is located at a position directly adjacent to one end of the core in a longitudinal direction of the core, and the terminal mount is located directly adjacent to the connection terminal, and the bobbin has a bobbin opening that is located directly adjacent to the terminal mount.

18. The antenna according to claim 17, wherein the core is supported by the inner surface of the bobbin that is located opposite to the bobbin opening, the inner surface that is opposite to the bobbin opening is configured with a flat surface, an edge, and a step, and the edge is continuously connected between an end of the flat surface and an end of the step, and the core is configured to move by using the edge as a fulcrum when an external force is applied to the antenna device.

19. The antenna according to claim 8, wherein the case includes:

a tubular storage that houses the integrated assembly;

a pair of risers that outwardly extend from the tubular storage so that the tubular storage is spaced apart from an external part; and a case mount that is fixed to the external part, and a space is provided between the pair of risers.

20. The antenna according to claim 19, wherein one of the pair of risers is provided directly adjacent to one end of the tubular storage in a longitudinal direction of the tubular storage, and the other of the pair of risers is provided directly adjacent to the other end of the tubular storage in the longitudinal direction of the tubular storage, and each of the pair of risers has two projections that are provided at both ends of the tubular storage in a width direction of the tubular storage, respectively, and the two projections are connected by a beam plate.

21. The antenna according to claim 20, wherein the tubular storage is a quadrangular prism, the two projections continuously extend from two parallel side surfaces of the tubular storage so that two projections are parallel to each other, and the beam plate is perpendicular to the two projections.

22. The antenna according to claim 19, wherein the tubular storage is a quadrangular prism, the case mount is configured with a pair of side extension plates spaced apart from each other, and the pair of side extension plates extend from a side surface of the tubular storage, and a cutout is provided between the pair of side extension plates.

23. The antenna according to claim 19, wherein the tubular storage is a quadrangular prism, and the case mount is in a plate shape, a rib plate connects the tubular storage and the case mount, and the rib plate is perpendicular to a mounting surface of the case mount and perpendicular to side surfaces of the tubular storage, and the rib plate is provided at each of two edges of the mounting surface of the case mount.

* * * * *